US010961954B2

(12) United States Patent
Teramoto et al.

(10) Patent No.: US 10,961,954 B2
(45) Date of Patent: Mar. 30, 2021

(54) VALVE DEVICE AND FUEL EVAPORATION GAS PURGE SYSTEM

(71) Applicant: HAMANAKODENSO CO., LTD., Kosai (JP)

(72) Inventors: Yoshifumi Teramoto, Kosai (JP); Masahiro Sato, Kosai (JP); Chiaki Kurita, Kosai (JP)

(73) Assignee: HAMANAKODENSO CO., LTD., Kosai (JP)

( * ) Notice: Subject to any disclaimer, the term of this patent is extended or adjusted under 35 U.S.C. 154(b) by 0 days.

(21) Appl. No.: 16/695,372

(22) Filed: Nov. 26, 2019

(65) Prior Publication Data

US 2020/0095958 A1 Mar. 26, 2020

Related U.S. Application Data

(63) Continuation of application No. PCT/JP2018/020155, filed on May 25, 2018.

(30) Foreign Application Priority Data

Jun. 7, 2017 (JP) ..... JP2017-112951
Apr. 25, 2018 (JP) ..... JP2018-084396

(51) Int. Cl.
*F02M 25/08* (2006.01)
*F02D 41/00* (2006.01)

(52) U.S. Cl.
CPC ..... *F02M 25/0836* (2013.01); *F02D 41/004* (2013.01); *F02D 41/0037* (2013.01); *F02M 25/089* (2013.01)

(58) Field of Classification Search
CPC ..... F02M 25/0836; F02M 25/089; F02D 41/0037; F02D 41/004
USPC ..... 123/519
See application file for complete search history.

(56) References Cited

U.S. PATENT DOCUMENTS

2002/0162457 A1 11/2002 Hyodo et al.
2016/0061154 A1* 3/2016 Swartz ..... F02D 41/22 123/520
2016/0369714 A1 12/2016 Burleigh et al.
2017/0129329 A1* 5/2017 Tochihara ..... B60K 15/03504

FOREIGN PATENT DOCUMENTS

JP 4082004 B2 4/2008

* cited by examiner

*Primary Examiner* — Mahmoud Gimie
(74) *Attorney, Agent, or Firm* — Harness, Dickey & Pierce, P.L.C.

(57) ABSTRACT

A valve device includes an outflow port inserted in an engine port provided on an intake pipe so as to communicate with an intake passage. A leak port is inserted in the engine port and includes a leak passage into which evaporative fuel is allowed to flow regardless of a permitting state and a blocking state. A seal provides a sealed state between the outflow port and the engine port. Another seal provides a sealed state between the leak port and the engine port. The seal is positioned such that the sealed state of the seal becomes broken before breakage of the other seal when the outflow port and the leak port move in a direction away from the engine port.

10 Claims, 10 Drawing Sheets

VALVE DEVICE AND FUEL EVAPORATION GAS PURGE SYSTEM

CROSS REFERENCE TO RELATED APPLICATIONS

The present application is a continuation application of International Patent Application No. PCT/JP2018/020155 filed on May 25, 2018, which designated the U.S. and claims the benefit of priority from Japanese Patent Application No. 2017-112951 filed on Jun. 7, 2017, and Japanese Patent Application No. 2018-084396 filed on Apr. 25, 2018. The entire disclosures of all of the above applications are incorporated herein by reference.

TECHNICAL FIELD

The present disclosure relates to a valve device and a fuel evaporation gas purge system capable of controlling supply of evaporative fuel to an engine.

BACKGROUND

In a fuel evaporation gas purge system, during engine operation, a purge control valve is opened, and a purge pump is rotated forward to supply fuel vapor from an inside of a canister to an intake passage of an engine through a purge passage.

SUMMARY

According to at least one embodiment of the present disclosure, a valve device is attached to a passage forming member defining an intake passage of an engine that mixes and combusts combustion fuel and evaporative fuel flowing out of an inside of a fuel tank. The valve device includes a valve element that switches between a permitting state permitting inflow of the evaporative fuel into the intake passage and a blocking state blocking the inflow of the evaporative fuel into the intake passage. The valve device controls a flow of the evaporative fuel. The valve device includes: an inflow port having an inflow passage into which the evaporative fuel flows; an outflow port having a cylindrical shape and inserted into an engine port provided on the passage forming member so as to communicate with the intake passage, the outflow port including an internal passage into which the evaporative fuel flows from the inflow port in the permitting state or does not flow from the inflow port in the blocking state; a leak port having a cylindrical shape and inserted into the engine port, the leak port including a leak passage into which the evaporative fuel is allowed to flow from the inflow port regardless of the permitting state and the blocking state; an outflow seal providing a sealed state between the outflow port and the engine port; and a leak seal providing a sealed state between the leak port and the engine port. The outflow seal is positioned such that the sealed state of the outflow seal becomes broken before breakage of the sealed state of the leak seal when the outflow port and the leak port move in a direction away from the engine port.

DETAILED DESCRIPTION

Figure 1:
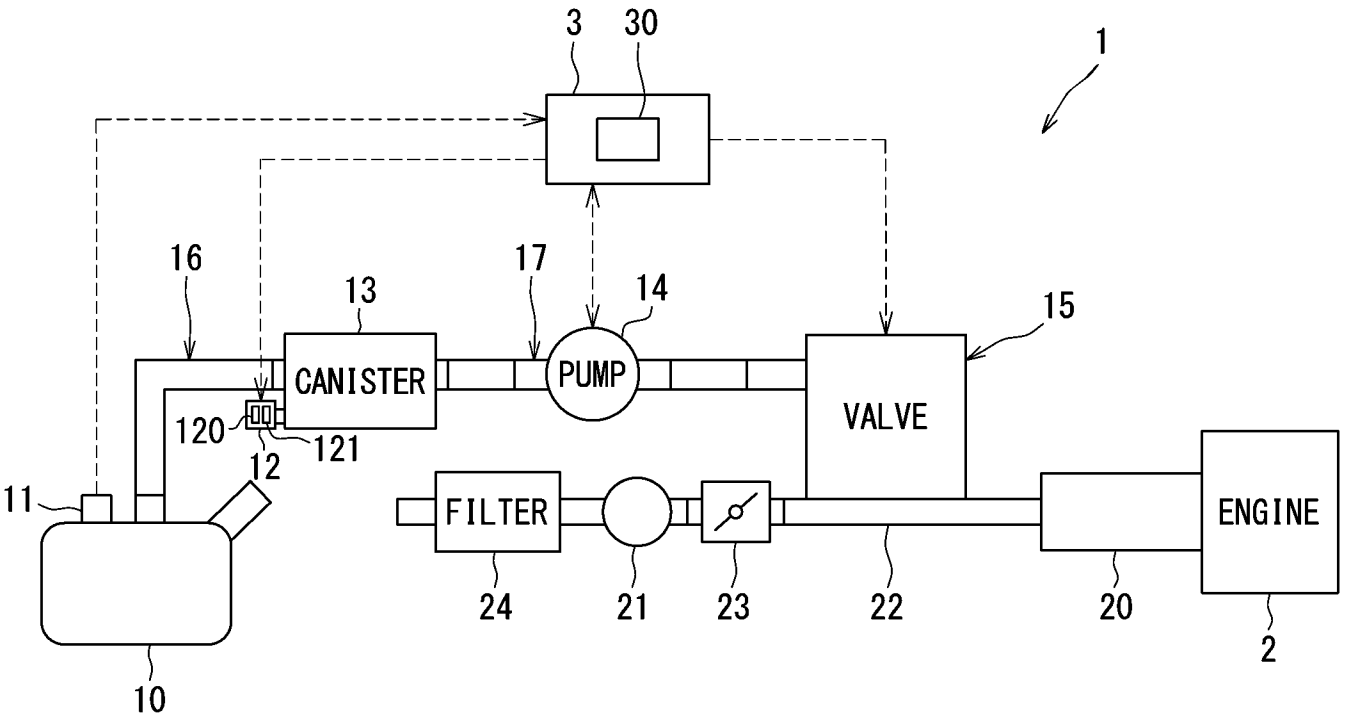
FIG. 1 is a schematic diagram illustrating a fuel evaporation gas purge system according to at least one embodiment.

In a fuel evaporation gas purge system of a comparative example, during engine operation, a purge control valve is opened, and a purge pump is rotated forward to supply fuel vapor from an inside of a canister to an intake passage of an engine through a purge passage.

In the system of the comparative example, if the purge control valve detached from the intake passage during a forward rotation of the purge pump and the purge control valve being open, continuous operation of the purge pump while the purge control valve is detached may cause release of the fuel vapor into the atmosphere.

According to an aspect of the present disclosure, a valve device is attached to a passage forming member defining an intake passage of an engine that mixes and combusts combustion fuel and evaporative fuel flowing out of an inside of a fuel tank. The valve device includes a valve element that switches between a permitting state permitting inflow of the evaporative fuel into the intake passage and a blocking state blocking the inflow of the evaporative fuel into the intake passage. The valve device controls a flow of the evaporative fuel. The valve device includes: an inflow port having an inflow passage into which the evaporative fuel flows; an outflow port having a cylindrical shape and inserted into an engine port provided on the passage forming member so as to communicate with the intake passage, the outflow port including an internal passage into which the evaporative fuel flows from the inflow port in the permitting state or does not flow from the inflow port in the blocking state; a leak port having a cylindrical shape and inserted into the engine port, the leak port including a leak passage into which the evaporative fuel is allowed to flow from the inflow port regardless of the permitting state and the blocking state; an outflow seal providing a sealed state between the outflow port and the engine port; and a leak seal providing a sealed state between the leak port and the engine port. The outflow seal is positioned such that the sealed state of the outflow seal becomes broken before breakage of the sealed state of the leak seal when the outflow port and the leak port move in a direction away from the engine port.

According to this valve device, even if the outflow port and the leak port move in the direction away from the engine port at the time of breakage of a proper attached state of the valve device in the blocking state, the sealed state of the outflow seal becomes broken before breakage of the sealed state of the leak seal. Accordingly, even when a sealing performance of the outflow seal is lost, a sealing performance of the leak seal can be maintained. Thus, the evaporative fuel flowing out from the leak passage can be made to flow into the intake passage without leaking to the external of the passage forming member through the engine port. Hence, in the valve device, external leakage of gas can be reduced when the proper attached state of the valve device is broken.

According to another aspect of the present disclosure, a valve device is attached to a passage forming member defining an intake passage of an engine that mixes and combusts combustion fuel and evaporative fuel flowing out of an inside of a fuel tank. The valve device includes a valve element that switches between a permitting state permitting inflow of the evaporative fuel into the intake passage and a blocking state blocking the inflow of the evaporative fuel into the intake passage. The valve device controls a flow of the evaporative fuel. The valve device includes: an inflow port having an inflow passage into which the evaporative fuel flows; an outflow port having a cylindrical shape and inserted into a main engine port provided on the passage forming member so as to communicate with the intake passage, the outflow port including an internal passage into which the evaporative fuel flows from the inflow port in the permitting state or does not flow from the inflow port in the blocking state; a leak port having a cylindrical shape and including a leak passage into which the evaporative fuel is allowed to flow from the inflow port regardless of the permitting state and the blocking state, the leak port being inserted into a sub engine port provided on the passage forming member so as to communicate with the intake passage independently of the main engine port; an outflow seal providing a sealed state between the outflow port and the main engine port; a first leak seal providing a sealed state between the leak port and the sub engine port; and a second leak seal providing a sealed state between the leak port and the sub engine port. The first leak seal is positioned such that the sealed state of the first leak seal becomes broken before breakage of the sealed state of the outflow seal and the second leak seal when the outflow port and the leak port move in a direction away from the main engine port and the sub engine port.

According to this valve device, even if the outflow port and the leak port move in the direction away from each of the engine ports at the time of breakage of a proper attachment state of the valve device in the blocking state, the sealed state of the first leak seal becomes broken before breakage of the sealed state of the outflow seal and the second leak seal. Thus, even when a sealing performance of the first leak seal is lost, the outflow seal and the second leak seal maintain their sealing performances. Therefore, the evaporative fuel or the like flowing out of the leak passage can be made to flow out to the intake passage without leaking from the sub engine port to the external of the passage forming member. Hence, in the valve device, external leakage of gas can be reduced when the proper attachment state of the valve device is broken.

Hereinafter, embodiments for implementing the present disclosure will be described referring to drawings. In each embodiment, portions corresponding to the elements described in the preceding embodiments are denoted by the same reference numerals, and redundant explanation may be omitted. In each of the embodiments, when only a part of the configuration is described, the other parts of the configuration can be applied to the other embodiments described above. The present disclosure is not limited to combinations of embodiments which combine parts that are explicitly described as being combinable. As long as no problems are present, the various embodiments may be partially combined with each other even if not explicitly described.

A fuel evaporation gas purge system 1 according to a first embodiment will be described with reference to FIGS. 1 to 6. The fuel evaporation gas purge system 1 supplies HC gas and the like, which are contained in fuel adsorbed to a canister 13, to an intake passage of an engine. The fuel evaporation gas purge system prevents fuel evaporation gas (referred to also as evaporative fuel, hereinafter) generated in a fuel tank 10 from being released to the atmosphere. The fuel evaporation gas purge system 1 may be referred to as a system 1 hereinafter. As shown in FIG. 1, the system 1 includes an intake system of an engine 2 which constitutes the intake passage of the engine 2, and an evaporative fuel purge system which supplies evaporative fuel to the intake system of the engine 2.

Evaporative fuel introduced into the intake passage of the engine 2 is mixed with combustion fuel supplied from an injector or the like to the engine 2 and burned in a cylinder of the engine 2. The engine 2 mixes at least the combustion fuel and the evaporative fuel desorbed from the canister 13, and burns the mixture. In the intake system 1 of the engine 2, an intake pipe 22 is connected to an intake manifold 20, and the intake pipe 22 is provided with a throttle valve 23, a turbocharger 21 and an air filter 24. The intake passage of the engine 2 includes the intake manifold 20, the intake pipe 22, the throttle valve 23, the turbocharger 21 and the air filter 24.

In the evaporative fuel purge system, the fuel tank 10 and the canister 13 are connected by a pipe constituting a vapor passage 16, and the canister 13 and the intake pipe 22 are connected via a purge valve 15 and a pipe constituting a purge passage 17. In addition, a purge pump 14 is provided in the purge passage 17. The purge passage 17 includes an internal passage of the purge pump 14 and an internal passage of the purge valve 15. The intake pipe 22 is an example of a passage forming member which defines the intake passage of the engine 2.

The air filter 24 is provided at an upstream portion of the intake pipe 22 and captures dust, and dirt, etc. in intake air. The throttle valve 23 is an intake amount adjustment valve that adjusts an amount of intake air flowing into the intake manifold 20 by adjusting an opening degree at an inlet of the intake manifold 20. The turbocharger 21 compresses the intake air that has passed through the air filter 24 and supplies the intake air to the intake manifold 20. The intake air in the intake passage passes through the air filter 24, the turbocharger 21, and the throttle valve 23 in sequence, and flows into the intake manifold 20. Then, the intake air is mixed with the combustion fuel injected from the injector or the like at a predetermined air-fuel ratio to be burned in the cylinder.

The fuel tank 10 is a container for storing fuel such as gasoline. The fuel tank 10 is connected to an inflow portion of the canister 13 by the pipe constituting the vapor passage 16. The canister 13 is a container in which an adsorbent such as activated carbon is sealed. The canister 13 takes in evaporative fuel generated in the fuel tank 10 from through the vapor passage 16 and temporarily adsorbs the evaporative fuel to the adsorbent. The canister 13 is integrally provided with a valve module 12. The valve module 12 includes therein a canister close valve 120 that opens and closes a suction portion through which external fresh air is drawn, and an inner pump 121 capable of releasing gas to the atmosphere and suctioning atmosphere air. The canister close valve 120 is also referred to as CCV 120. Since the canister 13 includes the canister close valve 120, atmospheric pressure can be introduced in the canister 13. The canister 13 can easily release, i.e. purge the evaporative fuel adsorbed to the adsorbent by the fresh air drawn in.

An outflow portion of the canister 13 from which the evaporative fuel desorbed from the adsorbent flows out is connected to one end of a pipe forming a part of the purge passage 17. Another end of the pipe is connected to an inflow portion of the purge pump 14. Further, the purge pump 14 and the purge valve 15 are connected by a pipe forming a part of the purge passage 17. The purge pump 14 is a purge fluid driver provided with a turbine rotated by an actuator such as a motor, and sends evaporative fuel from the canister 13 toward the intake passage of the engine 2.

The purge valve 15 is an open-close device having a valve element 152 for opening and closing the purge passage 17. That is, the purge valve 15 is also an open-close device having the valve element 152 for opening and closing a fuel supply passage 153 provided inside a body 150, and is capable of allowing and preventing supply of the evaporative fuel from the canister 13 to the engine 2. The purge valve 15 is formed of an electromagnetic valve device that includes a valve element 152, an electromagnetic coil 151 and a spring.

The purge valve 15 is switched to an energized state or a non-energized state by a controller 3 such that an opening degree of the fuel supply passage 153 is controlled between a fully open state or a fully closed state. The purge valve 15 is, by the switching between the energized state and the non-energized state, capable of switching between a permitting state permitting inflow of the evaporative fuel into the intake passage and a blocking state blocking the inflow of the evaporative fuel into the intake passage. The purge valve 15 opens the fuel supply passage 153 when the valve element 152 is separated from a valve seat 157 formed in a second member **150*b* of the body 150. The valve element 152 is moved according to a difference between an electromagnetic force generated by energization of the electric circuit having the electromagnetic coil 151** and a biasing force of the spring.

The purge valve 15 is, for example, a valve device that maintains the closed state of the fuel supply passage 153 at the time of normal operation. The purge valve 15 is a normally-closed valve device controlled to be in a closed state in which the fuel supply passage 153 is closed when a voltage is not applied to the purge valve 15, and controlled to be in an open state in which the fuel supply passage 153 is open when a voltage is applied to the purge valve 15. The purge valve 15 is an example of a valve device capable of allowing and preventing inflow of the evaporative fuel into the intake passage of the intake pipe 22 from a purge passage extending from the inside of the fuel tank 10 to the connection portion with the intake passage of the engine 2. Such valve device may include an on-off valve which switches between the fully open state and the fully closed state instead of the purge valve 15 capable of adjusting an opening degree. In this case, the on-off valve as the valve device is attached to the intake pipe 22, and the purge valve 15 for adjusting a flow rate is disposed in a passage from the fuel tank 10 to the on-off valve.

In the purge valve 15, when the electric circuit is energized by the controller 3, the electromagnetic force overcomes the elastic force of the spring and separates the valve element 152 from the valve seat 157, thereby opening the fuel supply passage 153. The controller 3 controls a duty ratio, i.e. a ratio of a turned-on period to a period of one cycle consisted of the turned-on period and a turned-off period of energization. The controller performs the energization of the electromagnetic coil 151 at the controlled duty ratio. The purge valve 15 is also referred to as a duty control valve. By the energization control of the purge valve 15, it is possible to adjust a flow rate of the evaporative fuel flowing through the fuel supply passage 153.

The system 1 is provided with the valve device attached to the intake pipe 22 which is the passage forming member forming the intake passage. The purge valve 15 as an example of the valve device will be described with reference to FIGS. 2 to 4. The purge valve 15 has a structure in which the body 150 is fixed to the intake pipe 22 at a fixation portion 156. The fixation portion 156 is fixed to a fastening means such as a screw, a bolt, or a bracket. The electromagnetic coil 151, the electric circuit, the valve element 152, and the fuel supply passage 153 are provided inside the body 150.

The purge valve 15 includes the body 150. The body 150 includes at least a first member **150*a* including therein a fuel supply passage 153 and an electromagnetic coil 151, and the second member 150*b* coupled to the first member 150*a*. Each of the first member 150*a* and the second member 150*b*** is formed of a resin material.

The first member **150*a* is a cup-shaped body having a bottom and an inflow port 154 at one end, and an opening at another end opposite to the one end. The opening has a shape like a running track. The first member 150*a* has a flange that protrudes radially outward from the entire circumference of the opening. The second member 150*b* has a flange overlapped and integrally joined with the flange of the first member 150*a*. The second member 150*b* includes an annular projection portion and a cylindrical portion, which protrude from a surface of the track-shaped flange of the second member 150*b* in its thickness direction. The annular projection portion of the second member 150*b* is fitted to an inner peripheral wall surface the other end of the first member 150*a*. In a state in which the first member 150*a* and the second member 150***b* are coupled to each other, an inner side of the annular projection portion is in communication with the internal passage of the first member 150*a*, and the first member 150*a* and the second member 150*b* support a filter interposed therebetween. The filter is provided in the internal passage of the first member 150*a* between the inflow port 154 and the fuel supply passage 153.

The cylindrical portion of the second member 150*b* is inside the annular protrusion and forms a leak passage 41 and the fuel supply passage 153. The tip end of the cylindrical portion has the valve seat 157 that contacts the valve element 152. In a state where the first member 150*a* and the second member 150*b* are coupled to each other, the cylindrical portion protrudes into the first member 150*a*. The cylindrical portion has therein the fuel supply passage 153 into which evaporative fuel flows from the inflow port 154 when the valve element 152 is in a valve open state.

The inflow port 154 of the first member 150*a* defines an inflow passage into which the evaporative fuel flows from the canister 13. The second member 150*b* includes an outflow port 155 leading to the inflow port 154 through the internal passage of the first member 150*a* and communicating with the intake passage. The outflow port 155 has a cylindrical shape and has a passage into which the evaporative fuel from the inflow port 154 flows in the permitting state and does not flow in the blocking state. Further, the second member 150*b* includes a leak port 4 leading to the inflow port 154 through the internal passage provided inside the first member 150*a* and also leading to an outside of the body 150. The leak passage 41 of the leak port 4 is also connected to the fuel supply passage 153 when the valve element 152 is separated from the valve seat 157. The leak port 4 has a cylindrical shape in which the internal leak passage 41 is connected to the internal passage of the body 150, and protrudes similar to the outflow port 155 of the second member 150*b*.

The leak port 4 and the outflow port 155 are integrated so as to be coaxial to each other, and are provided in the second member 150*b* of the body 150. The outflow port 155 has the fuel supply passage 153 therein. The cylindrical leak passage 41 is provided inside the leak port 4. The leak passage 41 is provided in the second member 150*b* so as to be coaxial with the fuel supply passage 153 in the outflow port 155, and is a passage having an annular cross section that surrounds the outside of the cylindrical fuel supply passage 153. Therefore, the leak port 4 has a shape having an outer diameter larger than that of the outflow port 155. A plurality of leak ports 4 may be provided around the fuel supply passage 153.

The end of the outflow port 155 protrudes toward the intake passage more than the leak port 4. The outflow port 155 has a constricted portion 158 projecting closer to the intake passage than the leak port 4 and positioned closer to the valve element 152 than a sealed portion externally fitted with a seal 1550. The constricted portion 158 has a smaller outer diameter than the leak port 4 and the sealed portion externally fitted with the seal 1550. The constricted portion 158 corresponds to a portion of the outflow port 155 located between the end of the outflow port 155 and the leak port 4. Accordingly, in the outflow port 155, the portion close to the leak port 4 is thinner than the end part of the outflow port 155 inscribed in an internal hole portion 220 provided in an engine port. According to this configuration, the portion of the outflow port 155 close to the leak port 4 can be made to be flexible.

The intake pipe 22 has the engine port through which the internal passage of the purge valve 15 communicates with the intake passage. The engine port includes the internal hole portion 220 into which the outflow port 155 is inserted, and an external hole portion 221 which is adjacent to an external side of the internal hole portion 220 and into which the leak port 4 is inserted. Therefore, the engine port forms a through hole portion penetrating the tube cross section of the intake pipe 22, in which the recess portion corresponding to the external hole portion 221 and the internal hole portion 220 penetrating the center of the recess portion are provided in this order from the external to the internal of the intake pipe 22. The external means an outside of the intake passage that is provided inside the passage forming member.

Figure 2:
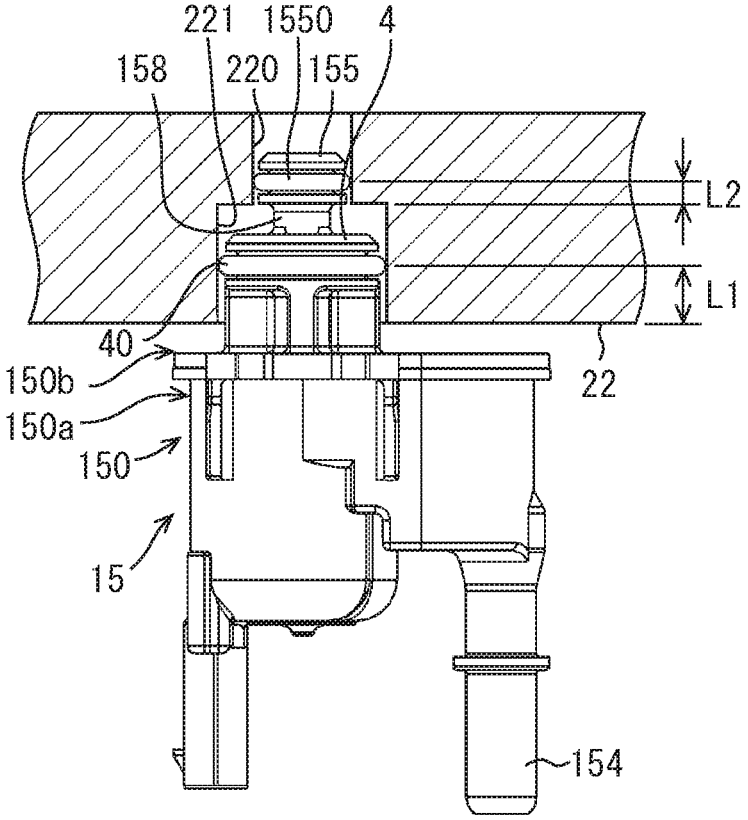
FIG. 2 is a partial sectional view illustrating a connection structure between a purge valve and an intake pipe in the fuel evaporation gas purge system.
Figure 3:
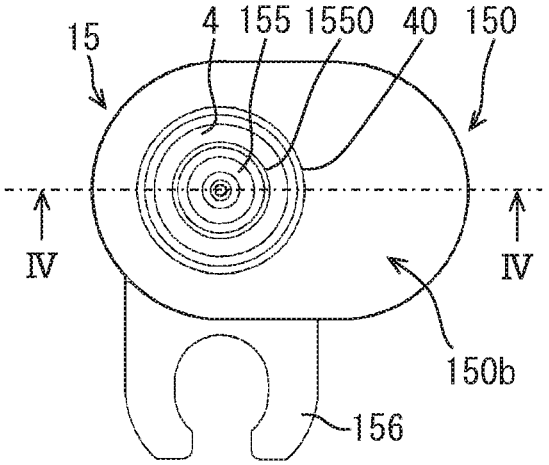
FIG. 3 is a top view illustrating the purge valve.
Figure 4:
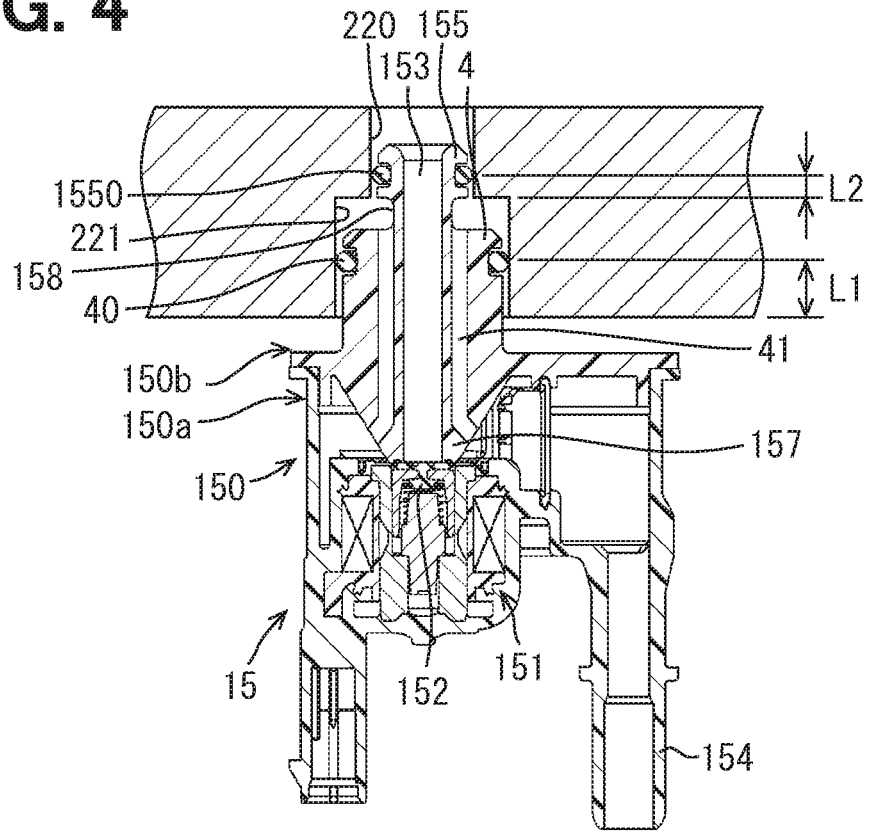
FIG. 4 is a sectional view illustrating the connection structure between the purge valve and the intake pipe.

As shown in FIGS. 2 and 4, when the valve device is properly attached to the intake pipe 22, the outflow port 155 is inserted into the internal hole portion 220 and the external hole portion 221 through which the outside of the intake pipe 22 communicates with the intake passage. A gap between the outer peripheral surface of the outflow port 155 and the inner peripheral surface of the internal hole portion 220 is sealed by the seal 1550 such as an O-ring attached to the outer circumference of the outflow port 155. The seal 1550 is an outflow seal which closely adheres to the outflow port 155 and the engine port to provide a sealed state therebetween.

As shown in FIGS. 2 and 4, when the valve device is properly attached to the intake pipe 22, the leak port 4 is inserted into the external hole portion 221 of the intake pipe 22 so as to be housed inside the external hole portion 221. A gap between the outer peripheral surface of the leak port 4 and the inner peripheral surface of the external hole portion 221 is sealed by a seal 40 such as an O-ring attached to the outer circumference of the leak port 4. The seal 40 is a leak seal which closely adheres to the leak port 4 and the engine port to provide a sealed state therebetween. The end portion of the leak passage 41 facing the intake passage is located between the end portion of the internal passage of the outflow port 155 facing the intake passage and the purge passage 17 or the external of the intake pipe 22. Therefore, in this proper attachment state, the passage leading from the inflow port 154 to the leak passage 41 through the internal passage is dead-end by the seal 1550 and the seal 40 which contact the engine port. As described above, the leak port 4 is provided with a leakage prevention structure for preventing the evaporative fuel and exhaust gas from leaking to the outside when the purge valve 15 is properly attached to the intake pipe 22.

A distance L1 in an axial direction of the external hole portion 221 between the seal 40 and an open end of the external hole portion 221 that faces the purge passage 17 or the external of the intake pipe 22 is set to be larger than a distance L2 in an axial direction of the internal hole portion 220 between the seal 1550 and an open end of the internal hole portion 220 that faces the purge passage 17 or the external of the intake pipe 22. According to this configuration, when the purge valve 15 is moved in the axial direction so as to be detached from the intake pipe 22, the seal 1550 is detached from the engine port before the seal 40 is detached from the engine port because L2 is shorter than L1. As a result, even if the seal 1550 has lost sealing performance, the seal 40 is maintained in the sealed state. In this state, the leak passage 41 communicates with the intake passage, but is shut off from the outside of the intake pipe 22 by the sealed state of the seal 40, so that the gas in the purge passage 17 is prevented from flowing out to the atmosphere through the leak passage 41.

The electric circuit is connected to a connector for connecting to an electric wire to which an electric current from the outside is supplied. Therefore, electric power is supplied to the electric circuit through the electric wire. The electric circuit is energized via the electric wire connected by the connector, the electromagnetic coil 151 generates electromagnetic force, and the valve element 152 is driven by the electromagnetic force to open the fuel supply passage 153.

The controller 3 is an electronic control unit of the fuel evaporation gas purge system 1. The controller 3 includes at least one processing unit (CPU) and at least one memory unit as a storage medium which stores a program and data. The controller 3 is provided by a microcontroller including a computer-readable storage medium. The storage medium is a non-transitional tangible storage medium that stores a computer-readable program in a non-transitory fashion. The storage medium may be provided by a semiconductor memory, a magnetic disk, or the like. The controller 3 may be provided by a set of computer resources linked by a computer or data communication device. The program is executed by the controller 3 to cause the controller 3 to function as the device described in this specification and to function the controller 3 to execute the method described in this specification.

Means and/or functions provided by the control system can be provided by software recorded in a substantive memory device and a computer that can execute the software, software only, hardware only, or some combination of them. For example, if the controller 3 is provided by an electronic circuit that is hardware, it can be provided by a digital circuit or analog circuit that includes multiple logic circuits.

The controller 3 performs basic control such as fuel purging in the system 1, and determines whether there is abnormality such as leakage of evaporative fuel by an abnormality determination circuit 30 functioning as an abnormality determining device. The abnormality is determined when the sealed state between the outflow port 155 and the engine port is broken and the evaporative fuel flows from the purge passage 17 to the intake passage through the leak passage 41. The controller 3 is connected to the respective actuators of the purge pump 14, the purge valve 15, the CCV 120, and the inner pump 121, and controls these operations.

The controller 3 is connected to an actuator such as a motor of the purge pump 14, and can control an operation and stop of the purge pump 14 by driving the motor irrespective of an operation and stop of the engine 2. The controller 3 is connected to a motor of the inner pump 121, and can control an operation and stop of the inner pump 121 by driving the motor irrespective of an operation and stop of the engine 2. An input port of the controller 3 receives signals corresponding to, for example, a rotational speed of the engine 2, an intake air amount, a cooling water temperature, and a signal corresponding to the inner pressure of the fuel tank 10 by a pressure sensor 11.

Evaporative fuel drawn into the intake manifold 20 from the canister 13 is mixed with original combustion fuel supplied from the injector or the like to the engine 2 and burned in the cylinder of the engine 2. In the cylinder of the engine 2, the air-fuel ratio which is the mixing ratio of the combustion fuel and the intake air is controlled to be a predetermined air-fuel ratio set in advance. The controller 3 adjusts a purge amount of the evaporative fuel by the duty-control of the open-closed periods of the purge valve 15 such that the predetermined air-fuel ratio is maintained even if the evaporative fuel is purged.

Although the fuel evaporation gas purge system 1 is a system for preventing the evaporative fuel generated in the fuel tank 10 from being released to the atmosphere, there is a concern that fuel vapor is released to the atmosphere from a leakage point caused by occurrence of leakage in the evaporative fuel purge system or detachment of a device. Further, even if such an abnormality such as leakage or hole occurs, a driver of the vehicle may not be aware of this abnormality and leave it.

Therefore, the system 1 according to the first embodiment determines whether the valve device is detached from the passage forming member and the seal between the leak passage 41 and the engine port is detached. The system 1 can early detect the occurrence of the abnormality, i.e. unsealing between the leak passage 41 and the engine port.

Figure 5:
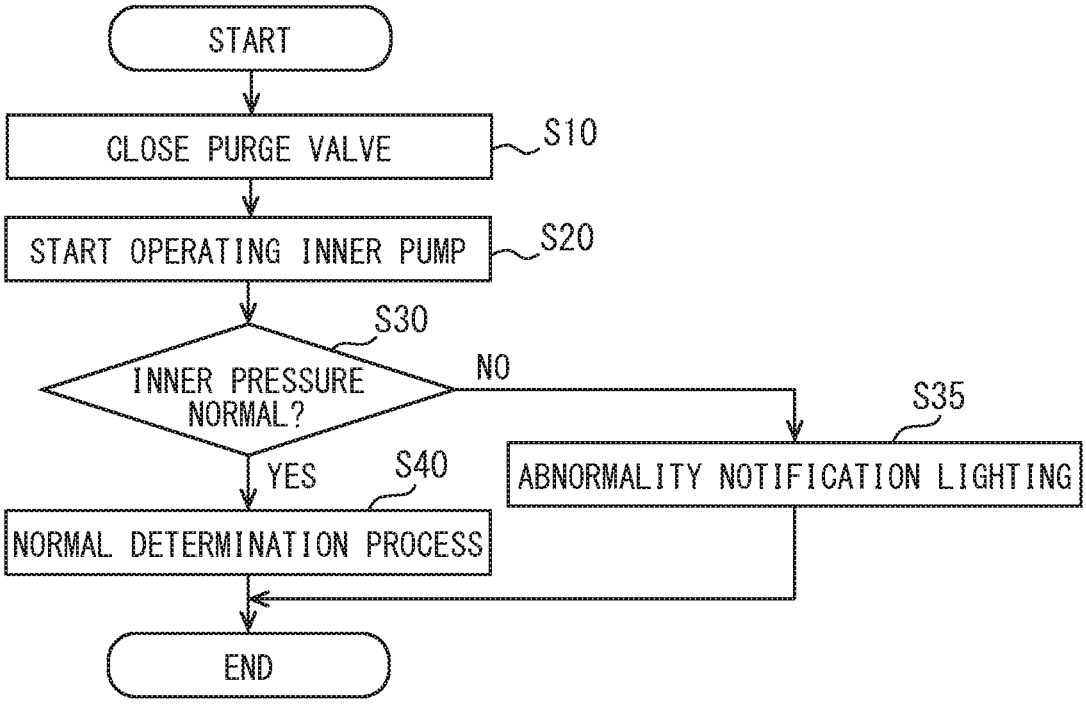
FIG. 5 is a flowchart showing a detection control of abnormality such as leakage in the fuel evaporation gas purge system according to at least one embodiment.

The abnormality detection control will be described with reference to the flowchart of FIG. 5 and the graph of FIG. 6. The controller 3 executes the process according to the flowchart of FIG. 5. This flowchart is operated irrespective of whether the vehicle is traveling with operating the engine 2 or parking with stopping the engine 2. The abnormality detection control of the system 1 can be executed periodically regardless of whether the engine 2 is turned on or off.

When the flowchart starts, the controller 3 controls the purge valve 15 at step S10 such that no electric current is supplied to the electric circuit. Thus, the purge valve 15 is controlled to a closed state. The controller 3 starts an operation of the inner pump 121 at step S20. As a result, gas in the passage from the inside of the fuel tank 10 to the purge valve 15 is discharged to the outside by the inner pump 121. Thus, the pressure inside the fuel tank 10 becomes negative, i.e. lower than the atmospheric pressure.

The controller 3 keeps this state for a certain time to create a determinable situation in which detachment of the purge valve 15 as the valve device can be detected. At step S30, the controller 3 acquires a signal related to the inner pressure of the fuel tank 10 detected by the pressure sensor 11, and the abnormality determination circuit 30 determines whether a normal condition of the valve device is satisfied. The normal condition of the valve device is a condition for determining during the determinable situation whether the valve device is in a normal state in which there is no abnormality such as detachment of the valve device.

Figure 6:
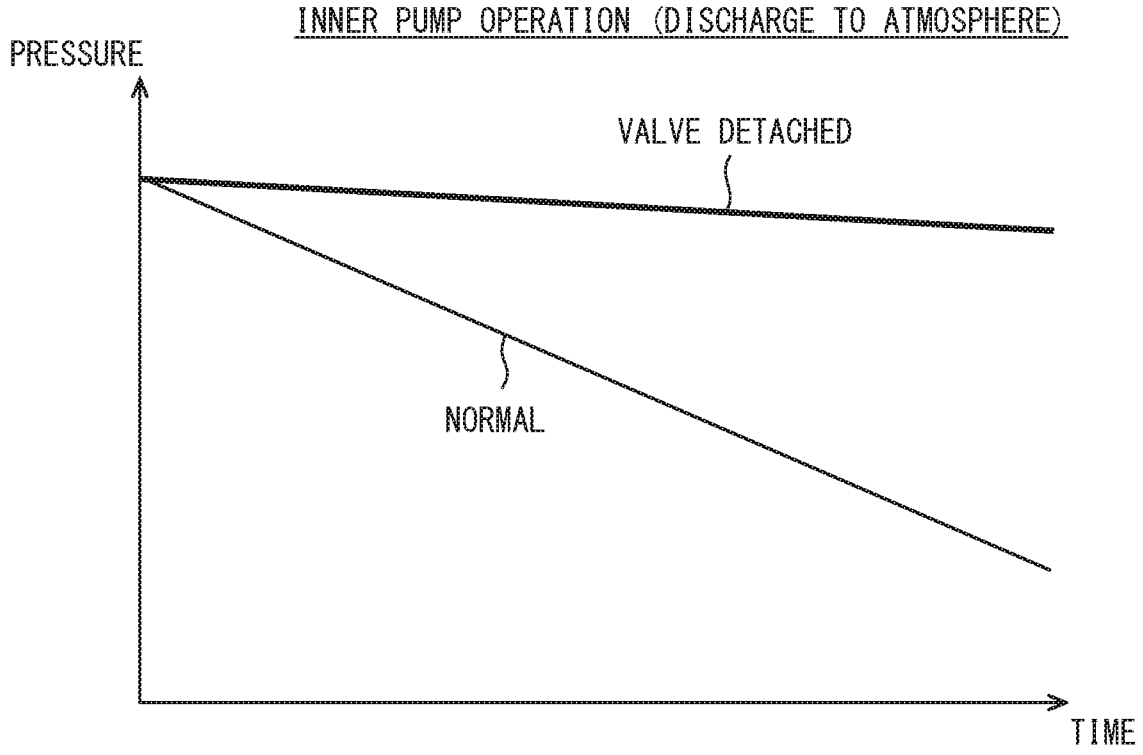
FIG. 6 is a graph showing pressure changes in a normal state and a detached state of the purge valve in at least one embodiment.

In this situation, when the sealed state of the seal 40, 1550 is normal, the pressure value detected by the pressure sensor 11 decreases continuously from the atmospheric pressure in accordance with operation of the inner pump 121 as shown by the thin line of pressure change in FIG. 6. On the other hand, when the sealed state of the seal 40, 1550 is broken, i.e. abnormal, gas is discharged from the leak port 4 to the intake passage. Thus, the negative pressure state is not accelerated, and the detected pressure value does not decrease as fast as the normal state, as shown by the thick line "VALVE DETACHED" in FIG. 6. The normal condition is satisfied when an absolute value of the pressure change per unit time (i.e. pressure change rate) is equal to or larger than a predetermined change rate. Therefore, when the absolute value of the pressure change rate is smaller than the predetermined value, the abnormality determination circuit 30 determines that there is an abnormality. When the absolute value of the pressure change rate is equal to or larger than the predetermined change rate, it determines that it is normal.

When the abnormality determination circuit 30 determines at step S30 that the normal condition is not satisfied, the abnormality determination circuit 30 at step S35 indicates that the valve device is in an abnormal state, and then terminates the current abnormality detection control. Based on this indication, the user can perform a repair. When a predetermined time has elapsed since completion of the repair, the process starts again from step S10.

The abnormal indication at step S35 is performed by lighting up or flashing a predetermined lamp to indicate that there is an abnormality in the valve device, or by showing the abnormality on a predetermined screen. The abnormal indication may also be performed alternatively by generating an alarm sound or voice warning alarm such as an abnormality.

When the abnormality determination circuit 30 determines at step S30 that the normal condition is satisfied, the current determination result is that the inner pressure is normal. Thus, the abnormality determination circuit 30 at step S40 executes a normal determination process, and then terminates the current abnormality detection control. When a predetermined time has elapsed since the termination of the flowchart, the process starts again from step S10. As described above, the abnormality detection control of the system 1 can be executed at predetermined time intervals regardless of whether the engine 2 is operating.

The abnormality detection control may be performed in both running and parking, but it is preferable that the abnormality detection control is performed during parking. This is because the engine is stopped when parking, and a clear pressure change is easy to detect. Further, purge processing cannot be performed at the time of the leakage check. Thus, it is also beneficial from the viewpoint of the operation efficiency of the system 1 that the abnormality detection control is performed at the time of parking.

Next, the operational effects provided by the valve device of the first embodiment will be described. The purge valve 15 is attached to the passage forming member which forms the intake passage of the engine 2 which mixes and burns evaporative fuel flowing out of the fuel tank 10 and combustion fuel. The purge valve 15 is a valve device controlling flow of the evaporative fuel and including the valve element 152 that switches between a permitting state permitting inflow of the evaporative fuel into the intake passage and a blocking state blocking the inflow of the evaporative fuel into the intake passage. The valve device includes the inflow port 154, and the cylindrical outflow port 155 having the internal passage into which the evaporative fuel from the inflow port 154 flows in the permitting state and does not flow in the blowing state. The valve device further includes the cylindrical leak port 4, the outflow seal, and the leak seal. The outflow port 155 is inserted into the engine port formed in the passage forming member so as to communicate with the intake passage. The leak port 4 has the leak passage 41 into which the evaporative fuel from the inflow port 154 can flow regardless of the permitting state and the blocking state, and the leak port 4 is inserted into the engine port. The outflow seal provides a sealed state between the outflow port 155 and the engine port. The leak seal provides a sealed state between the leak port 4 and the engine port. When the outflow port 155 and the leak port 4 move in a direction away from the engine port, the outflow seal is provided such that the sealed state of the outflow seal becomes broken before breakage of the sealed state of the leak seal.

According to this valve device, even if the outflow port 155 and the leak port 4 move in the direction away from the engine port at the time of breakage of the proper attachment state of the valve device in the blocking state of the purge valve 15, the sealed state of the outflow seal becomes broken before breakage of the sealed state of the leak seal. Thus, even when the sealing performance of the outflow seal is lost, the sealing performance of the leak seal can be maintained. Thus, the evaporative fuel flowing out from the leak passage 41 can be made to flow into the intake passage without leaking to the outside from the engine port. According to this configuration, it is possible to provide a valve device capable of reducing external leakage of gas (i.e. leakage to the atmosphere) when the proper attachment state of the valve device is broken.

The outflow port 155 and the leak port 4 are provided in a coaxial relationship. According to this configuration, the fuel supply passage 153 of the outflow port 155 and the leak passage 41 are positioned inside the same object which is a single mass. When the valve device is detached from the passage forming member and the sealed state of the outflow port 155 becomes broken, the leak passage 41 and the internal hole portion 220 communicate with each other. Therefore, when the valve device is detached from the passage forming member, the system is capable of reliably detecting a leak state in which the leak passage 41 and the intake passage of the engine 2 communicate with each other.

Further, the leak port 4 is positioned outward of the outflow port 155 that is coaxial with the leak port 4. According to this configuration, the passage cross-section area of the leak passage 41 is easy to be enlarged. Thus, the leak port 4 is capable of generating a sensitive pressure change to be used for the leak detection. Therefore, the leak port 4 is capable of performing clear determination whether there is an abnormality.

Since the outflow port 155 and the leak port 4 are integrally provided in the coaxial positional relationship, the dimensional accuracy of the outflow port 155 and the leak port 4 can be easily secured. Moreover, it is easy to manufacture the inner peripheral surface shape of the engine port having a high sealing performance. Accordingly, it is possible to easily provide a structure that secures sealing performance between the engine port and each of the outflow port 155 and the leak port 4.

The engine port includes the internal hole portion 220 serving as a first hole portion into which the outflow port 155 is inserted and provided with the sealed state with the outflow port 155 by the outlet seal, and the external hole portion 221 serving as a second hole portion. Each of the internal hole portion 220 and the external hole portion 221 is a hole formed in the passage forming member. The leak port 4 is inserted into the external hole portion 221, and the external hole portion 221 is provided with the sealed state with the leak port 4 by the leak seal. The distance L1 in the axial direction between the leak seal and the open end of the external hole portion 221 facing the external is larger than the distance L2 in the axial direction between the outflow seal and the open end of the internal hole portion 220 facing the external.

According to the configuration, when the outflow port 155 and the leak port 4 move in a direction away from the engine port, the sealed state of the outflow seal can be broken before breakage of the sealed state of the leak seal. Accordingly, even when the sealing performance of the outflow seal is lost, the sealing performance of the leak seal can be maintained. Thus, the evaporative fuel flowing out from the leak passage 41 can be made to flow into the intake passage without leaking to the outside of the passage forming member through the engine port.

The outflow port 155 and the leak port 4 are provided in the coaxial relationship. The leak passage 41 is a cylindrical passage surrounding therein the internal passage of the outflow port 155. According to the configuration, a downstream end of the leak port 4 is between a downstream end of the outflow port 155 and the external of the passage forming member. Therefore, the sealed state of the outflow seal can be broken before breakage of the sealed state of the leak seal. Therefore, the leak port 4 and the outflow port 155 capable of exerting the desired function can be manufactured by a simple shape, and the productivity of the valve device can be enhanced.

The fuel evaporation gas purge system 1 includes the fuel tank 10, the canister 13, the passage forming member which forms the intake passage of the engine 2 which mixes and burns at least the evaporative fuel desorbed from the canister 13 and the combustion fuel, and the valve device described in this specification. According to this configuration, it is possible to provide the fuel evaporation gas purge system 1 capable of reducing external leakage of gas (i.e. leakage to the atmosphere) when the proper attachment sate of the valve device is broken.

The controller 3 operates the inner pump 121 (at step S10, step S20) in a state where the valve element 152 is controlled to be in the blocking state, and detects a pressure at a predetermined place included in a passage from the inside of the fuel tank 10 and a fuel filler opening to the valve device. When the absolute value of the rate of change in the pressure detected in this manner is smaller than the predetermined value, the controller 3 determines that there is an abnormality (at step S30, step S35).

According to the system 1, when the valve device is properly attached, i.e. normal, gas such as evaporative fuel enclosed in the passage is continuously discharged to the outside during the inner pump 121 discharging gas. Thus, the detected pressure becomes large in the degree of negative pressure relative to the atmospheric pressure. Further, when the valve device is abnormal, the leak passage 41 communicates with the outside. When the inner pump 121 discharges gas, the air introduced into the passage through the leak passage 41 is continuously discharged to the outside through the inner pump 121. Thus, the detected pressure becomes small in the degree of negative pressure relative to the atmospheric pressure. Thus, when the absolute value of the rate of change in the detected pressure is smaller than the predetermined change rate, the controller 3 can properly detect that the valve device is in the abnormal state. According to the system 1, erroneous detection can be reduced in the abnormality detection of the valve device.

The outflow port 155 has the constricted portion 158 which is smaller in outer diameter than the seal portion on which the outflow seal is provided and which is formed at a position farther from the intake passage than the seal portion is. According to this configuration, when the outflow port 155 is inserted into and installed in the internal hole portion 220 of the engine port, since the constricted portion 158 is flexible, the required accuracy with respect to the coaxial relation between the outflow port 155 and the leak port 4 can be reduced. Further, according to this configuration, it is possible to improve the workability of installing the outflow port 155 with respect to the engine port.

The purge valve 15 includes the first member 150*a* in which the drive unit for driving the valve element 152 is housed, and the second member 150*b* coupled to the first member 150*a* and having the outflow port 155 and the leak port 4. According to this configuration, it is possible to provide the purge valve 15 which does not need to newly prepare the first member 150*a* only by preparing the second member 150*b* having the outflow port 155 and the leak port 4 conforming to the specification of the engine port. Thus, for example, the purge valve 15 is capable of changing the configuration of the outflow port 155 and the leak port 4. Further, the purge valve 15 is applicable to an evaporative fuel processing system capable of being used for various vehicle product specifications, and can contribute to reducing the number of component management steps in the evaporative fuel processing system.

An abnormality detection control according to a second embodiment will be described with reference to FIGS. 5 and 7. In the following description, explanations for configurations, operations and effects of the second embodiment that are the same as those of the first embodiment will be omitted. That is, features of the second embodiment different from those of the first embodiment will be described hereafter.

The abnormality detection control of the second embodiment may be performed as follows. In the abnormality detection control of the second embodiment, the inner pump 121 is operated to introduce the air into the purge passage from the outside at step S20 in FIG. 5. As a result, the air is drawn into the passage leading from the inside of the fuel tank 10 to the purge valve 15 by the inner pump 121. Thus, the pressure inside the fuel tank 10 becomes positive, i.e. higher than the atmospheric pressure.

The controller 3 keeps this state for a certain time to create a determinable situation in which detachment of the purge valve 15 as the valve device can be detected. The normal condition of the valve device at step S30 is a condition for determining during the determinable situation whether the valve device is in a normal state in which there is no abnormality such as detachment of the valve device.

Figure 7:
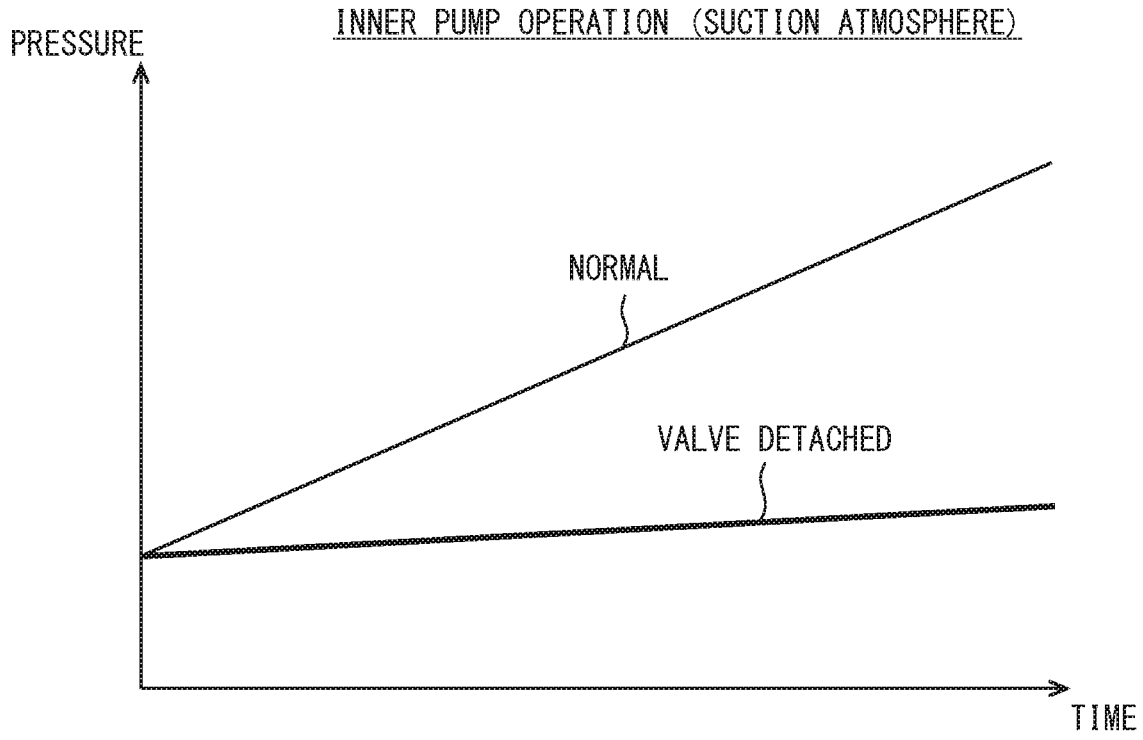
FIG. 7 is a graph showing pressure changes in a normal state and a detached state of a purge valve in at least one embodiment.

In this situation, when the sealed state of the seal 40, 1550 is normal, the pressure value detected by the pressure sensor 11 increases continuously from the atmospheric pressure in accordance with operation of the inner pump 121 as shown by the thin line of pressure change in FIG. 7. This is because the air is trapped in the passage by the seal 40, 1550 and the valve element 152 in the blocking state. On the other hand, when the sealed state of the seal 40, 1550 is broken, i.e. abnormal, air is discharged to the intake passage through the leak passage 41. Thus, the positive pressure state is not accelerated, and the pressure value does not increase as fast as the normal state, as shown by the thick line "VALVE DETACHED" in FIG. 7. The normal condition is satisfied when, for example, the absolute value of the pressure change (pressure change rate) per unit time is equal to or larger than a predetermined change rate. Therefore, when the absolute value of the pressure change rate is smaller than the predetermined change rate, the abnormality determination circuit 30 determines that it is abnormal. When the absolute value of the pressure change rate is greater than or equal to the predetermined change rate, the abnormality determination circuit 30 determines that it is normal.

According to the system 1, when the valve device is properly attached, i.e. normal, and the inner pump 121 introduces air into the passage, the air is continuously introduced into the passage, and the detected pressure of gas such as evaporative fuel enclosed in the passage becomes large in degree of positive pressure relative to the atmospheric pressure. Further, when the valve device is detached to the extent of the leak passage 41 communicating with the intake passage, the air introduced into the passage is continuously discharged to the intake passage through the leak passage 41. As a result, the detected pressure reduces in degree of positive pressure relative to the atmospheric pressure. When the absolute value of the pressure change rate in the detected pressure is smaller than the predetermined change rate, the controller 3 can properly detect that the valve device is in the abnormal state. Therefore, erroneous detection can be reduced in the abnormality detection of the valve device using the inner pump 121 that introduces the atmospheric air.

Figure 8:
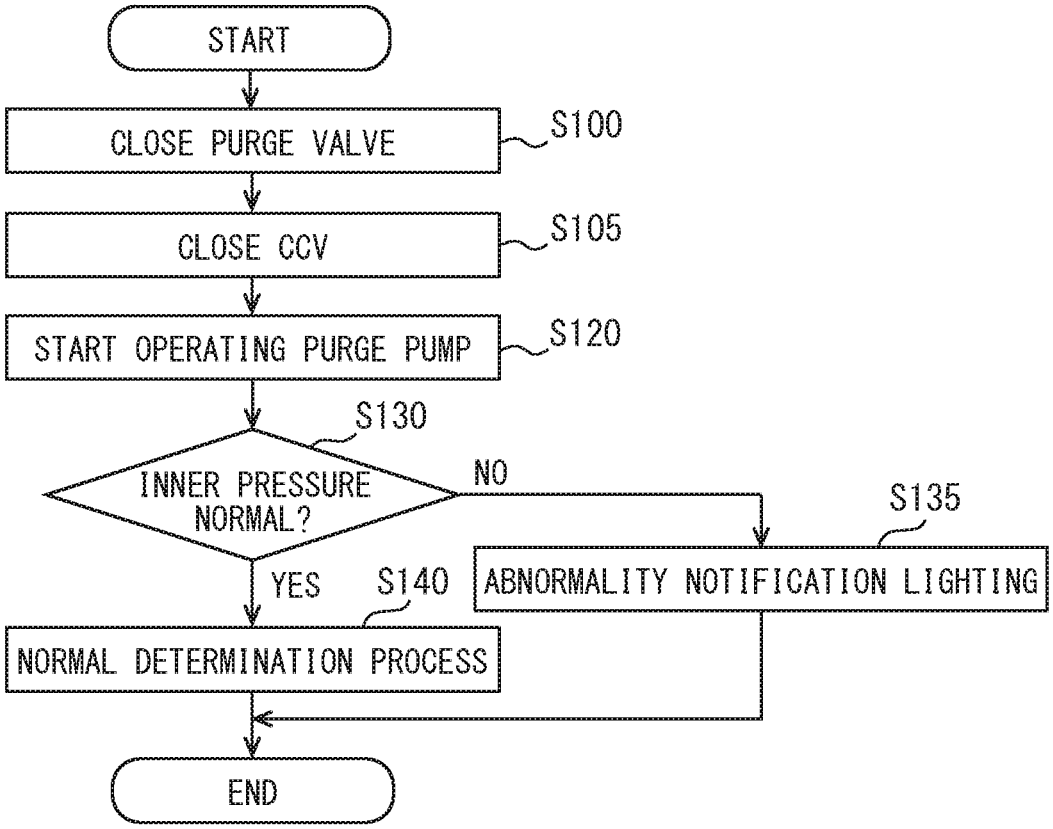
FIG. 8 is a flowchart showing a detection control of abnormality such as leakage in a fuel evaporation gas purge system according to at least one embodiment.
Figure 9:
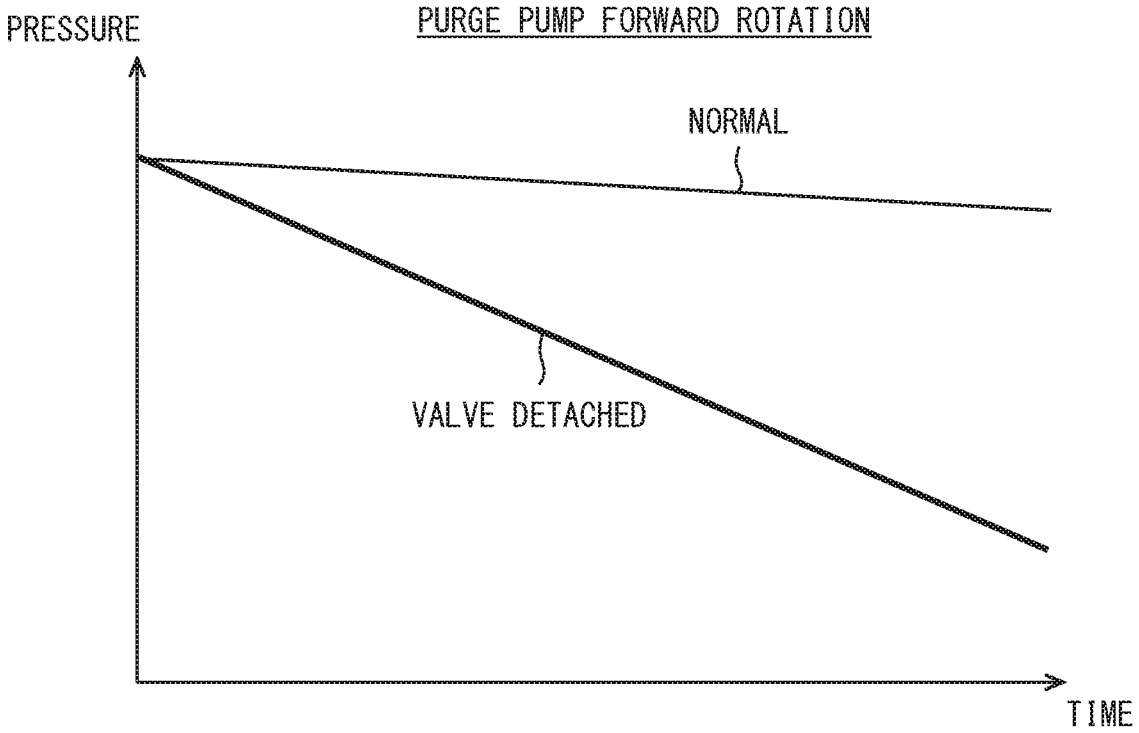
FIG. 9 is a graph showing pressure changes in a normal state and a detached state of a purge valve in at least one embodiment.

An abnormality detection control according to a third embodiment will be described with reference to FIGS. 8 and 9. In the following description, explanations for configurations, operations and effects of the third embodiment that are the same as those of the first embodiment will be omitted. That is, features of the third embodiment different from those of the first embodiment will be described hereafter.

Processes at steps S100, S135, and S140 in an abnormality detection control in the third embodiment correspond to and are similar to the processes at steps S10, S35, and S40 in the first embodiment, respectively.

When the flowchart starts, the controller 3 controls the purge valve 15 at step S100 such that no electric current is supplied to the electric circuit and the purge valve 15 is closed. The controller 3 further controls the CCV 120 to be closed at step S105, and operates the purge pump 14 in the forward rotation at step S120. Accordingly, when the purge valve 15 is properly attached, the passage leading from the inside of the fuel tank 10 to the purge valve 15 becomes closed. Since the gas sent toward the purge valve 15 by the purge pump 14 has nowhere to go, the pressure inside the fuel tank 10 becomes slightly lower than the atmospheric pressure.

At step S130, the controller 3 acquires a signal related to the inner pressure of the fuel tank 10 detected by the pressure sensor 11, and the abnormality determination circuit 30 determines whether the normal condition of the valve device is satisfied. In this situation, when the sealed state of the seal 40, 1550 is normal, the pressure value detected by the pressure sensor 11 decreases slightly from the atmospheric pressure in accordance with operation of the purge pump 14 as shown by the thin line of pressure change in FIG. 9. On the other hand, when the sealed state of the seal 40, 1550 is broken, i.e. abnormal, gas is discharged from the leak port 4 to the outside. Thus, the negative pressure state is not accelerated, and the detected pressure value largely decreases as compared with the normal state, as shown by the thick line "VALVE DETACHED" in FIG. 8. The normal condition is satisfied when, for example, the absolute value of the pressure change (pressure change rate) per unit time is equal to or smaller than a predetermined change rate, or the pressure change rate is smaller than the predetermined change rate. Therefore, when the absolute value of the pressure change rate is larger than the predetermined change rate, or the absolute value of the pressure change rate is equal to or larger than the predetermined change rate, the abnormality determination circuit 30 determines that it is abnormal. When the absolute value of the pressure change rate is equal to or smaller than the predetermined change rate, or the pressure change rate is smaller than the predetermined change rate, the abnormality determination circuit 30 determines that it is normal.

When the abnormality determination circuit 30 determines at step S130 that the normal condition is not satisfied, the abnormality determination circuit 30 at step S135 indicates that the valve device is in an abnormal state, and then terminates the current abnormality detection control. When a predetermined time has elapsed since the termination, the process starts again from step S100. When the abnormality determination circuit 30 determines at step S130 that the normal condition is satisfied, the current determination result is that the inner pressure is normal. Thus, the abnormality determination circuit 30 at step S140 executes a normal determination process, and then terminates the current abnormality detection control.

The controller 3 closes the CCV 120 and operates the purge pump 14 (at steps S100, S105 and S120) to rotate forward in a state where the valve element 152 is controlled to be in the blocking state, and detects a pressure at a predetermined place included in a passage leading from the inside of the fuel tank 10 and a fuel filler opening to the valve device. When the absolute value of the change rate in the pressure detected in such a manner is larger than or equal to the predetermined change rate, the controller 3 determines that there is an abnormality (at step S130, step S135).

According to the system 1, when the valve device is properly attached, i.e. normal, evaporative fuel in the passage has nowhere to go during the purge pump 14 pushing gas into the intake passage. Thus, the detected pressure becomes small in degree of negative pressure relative to the atmospheric pressure. Further, when the valve device is detached to the extent of the leak passage 41 communicating with the intake passage, the gas pushed by the purge pump 14 is continuously discharged to the intake passage through the leak passage 41. Hence, the pressure detected value becomes large in degree of negative pressure relative to the atmospheric pressure. Accordingly, when the absolute value of the rate of change in the detected pressure is larger than or equal to the predetermined change rate, the controller 3 can properly detect that the valve device is in the abnormal state. According to the system 1, erroneous detection can be reduced in the abnormality detection of the valve device using the purge pump 14 that rotates forward.

Figure 10:
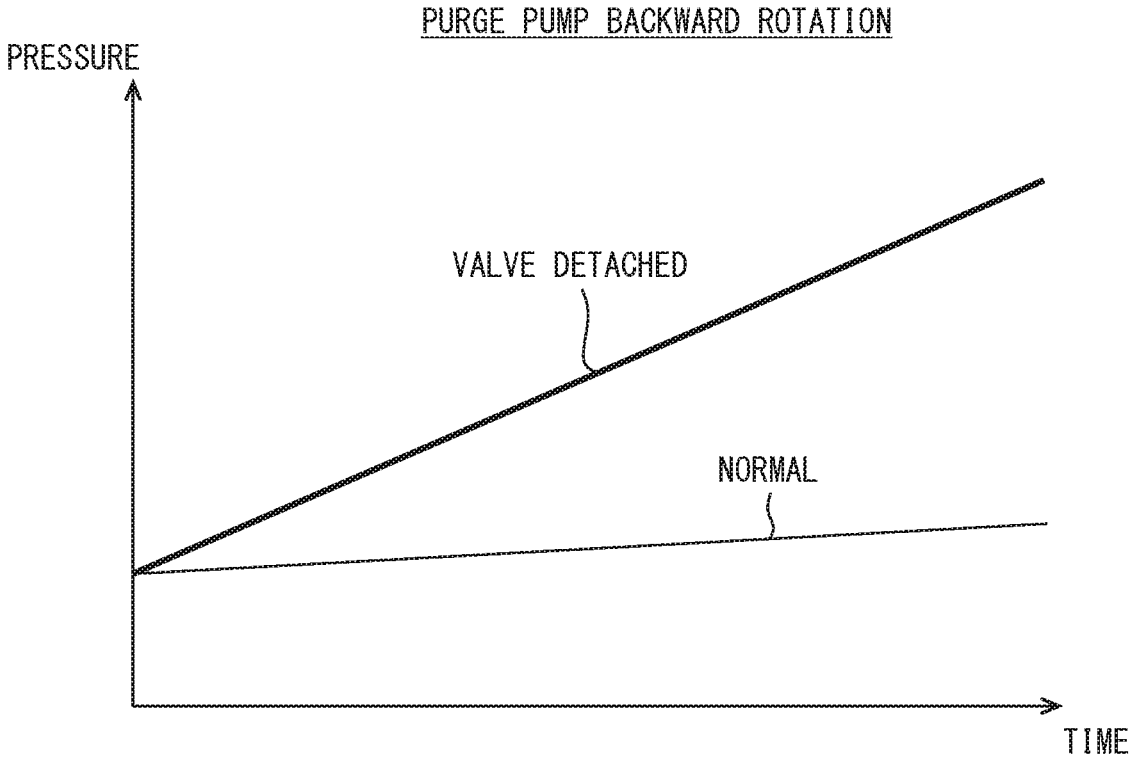
FIG. 10 is a graph showing pressure changes in a normal state and a detached state of a purge valve in at least one embodiment.

An abnormality detection control according to a fourth embodiment will be described with reference to FIGS. 8 and 10. In the following description, explanations for configurations, operations and effects of the fourth embodiment that are the same as those of the first and third embodiments will be omitted. That is, features of the fourth embodiment different from those of the first and third embodiments will be described hereafter.

The abnormality detection control of the fourth embodiment may be performed as follows. In the abnormality detection control of the fourth embodiment, the purge pump 14 is operated to rotate backward at step S120 in FIG. 8. In this situation, when the purge valve 15 is properly attached, the passage leading from the inside of the fuel tank 10 to the purge valve 15 becomes closed. Since the gas sent toward the fuel tank 10 by the purge pump 14 has nowhere to go, the pressure inside the fuel tank 10 becomes slightly higher than the atmospheric pressure.

The controller 3, during the determinable situation in which such situation is kept for a certain time period, determines at step S130 whether the valve device is in a normal state in which there is no abnormality such as detachment of the valve device. At step S130, when the sealed state of the seal 40, 1550 is normal, the pressure value detected by the pressure sensor 11 is in a low state which is slightly higher than the atmospheric pressure, as shown by the thin line of pressure change in FIG. 10.

On the other hand, when the sealed state of the seal 40, 1550 is broken, i.e. abnormal, the outside air is continuously supplied to the inside of the fuel tank 10 through the purge valve 15 or the like from the outflow port 155. Therefore, the pressure value changes in such a manner that the pressure value greatly increases as compared with the normal state, as shown by the thick line "VALVE DETACHED" in FIG. 10. The normal condition is satisfied when, for example, the absolute value of the pressure change (pressure change rate) per unit time is equal to or smaller than a predetermined change rate, or the pressure change rate is smaller than the predetermined change rate. Therefore, when the absolute value of the pressure change rate is larger than the predetermined change rate, or the absolute value of the pressure change rate is equal to or larger than the predetermined change rate, the abnormality determination circuit 30 determines that it is abnormal. When the absolute value of the pressure change rate is equal to or smaller than the predetermined change rate, or the pressure change rate is smaller than the predetermined change rate, the abnormality determination circuit 30 determines that it is normal.

The controller 3 closes the CCV 120 and operates the purge pump 14 (at steps S100, S105 and S120) to rotate backward in a state where the valve element 152 is controlled to be in the blocking state, and detects a pressure at a predetermined place included in a passage leading from the inside of the fuel tank 10 and a fuel filler opening to the valve device. When the absolute value of the change rate in the pressure detected in such a situation is larger than or equal to the predetermined change rate, the controller 3 determines that there is an abnormality (at step S130, step S135).

According to the system 1, when the valve device is properly attached, i.e. normal, and the purge pump 14 pushes gas toward the fuel tank 10, the detected pressure becomes small in degree of positive pressure relative to the atmospheric pressure. Further, when the valve device is detached to the extent of the leak passage 41 communicating with the intake passage, the gas sent toward the fuel tank 10 by the purge pump 14 is continuously introduced from the engine 2 into the intake passage through the leak passage 41. Hence, the pressure detected value becomes large in degree of positive pressure relative to the atmospheric pressure. Accordingly, when the absolute value of the rate of change in the detected pressure is larger than or equal to the predetermined change rate, the controller 3 can properly detect that the valve device is in the abnormal state. According to the system 1, erroneous detection can be reduced in the abnormality detection of the valve device using the purge pump 14 that rotates backward.

A valve device of a fuel evaporation gas purge system 1 according to a fifth embodiment will be described with reference to FIGS. 11 to 13. In each drawing, parts having configurations similar to the first embodiment are denoted by the same reference numerals as those in the first embodiment and exert similar operations and effects. In the following description, explanations for configurations, operations and effects of the fifth embodiment that are the same as those of the above-described embodiments will be omitted. That is, features of the fifth embodiment different from those of the above-described embodiments will be described hereafter. Parts in the fifth embodiment having configurations similar to the above-described embodiments exert operations and effects similar to those explained in the above-described embodiments.

Further, the purge valve 115 of the fifth embodiment includes a leak port 104 leading to the inflow port 154 through the internal passage provided inside the body 150 and also leading to an outside of the body 150. The leak port 104 has therein an internal leak passage 141 connected to the internal passage of the body 150, and is provided integrally with the outflow port 1155 protruding from the body 150. The leak port 104 is provided beside the outflow port 1155 on the main body 150 and has a leak passage 141 extending in the same direction as the fuel supply passage 153. The central axis of the fuel supply passage 153 of the outflow port 1155 and the central axis of the leak passage 141 are arranged apart from each other. The leak port 104 has an oval outer periphery that surrounds the fuel supply passage 153 and the leak passage 141.

The purge valve 115 includes the body 150. The body 150 includes at least a first member 150*a* including therein the fuel supply passage 153 and an electromagnetic coil 151, and a second member 1150*b* coupled to the first member 150*a*. Each of the first member 150*a* and the second member 1150*b* is formed of a resin material.

The second member 1150*b* has a flange overlapped and integrally joined with the flange of the first member 150*a*. The second member 1150*b* includes a cylindrical portion which protrudes from a surface of the track-shaped flange of the second member 150*b* in its thickness direction. In a state in which the first member 150*a* and the second member 1150*b* are coupled to each other, the first member 150*a* and the second member 1150*b* support a filter interposed therebetween.

The cylindrical portion of the second member 1150*b* forms the fuel supply passage 153. In a state where the first member 150*a* and the second member 1150*b* are coupled to each other, the cylindrical portion protrudes into the first member 150*a*. The cylindrical portion has therein the fuel supply passage 153 into which evaporative fuel flows from the inflow port 154 when the valve element 152 is in a valve open state.

The second member 1150*b* includes an outflow port 1155 leading to the inflow port 154 through the internal passage of the first member 150*a* and communicating with the intake passage. Further, the second member 1150*b* includes the leak port 104 leading to the inflow port 154 through the internal passage provided inside the first member 150*a* and also leading to an outside of the body 150. The leak passage 141 of the leak port 104 is also connected to the fuel supply passage 153 when the valve element 152 is separated from the valve seat 157. The leak port 104 has a cylindrical shape in which the internal leak passage 141 is connected to the internal passage of the body 150, and protrudes similar to the outflow port 1155 of the second member 1150*b*.

The end of the outflow port 1155 protrudes toward the intake passage more than the leak port 104. The outflow port 1155 has a constricted portion 158 projecting closer to the intake passage than the leak port 104 and positioned closer to the valve element 152 than a seal portion externally fitted with a seal 1550. The constricted portion 158 has a smaller outer diameter than the leak port 104 and the sealed portion externally fitted with the seal 1550. The constricted portion 158 corresponds to a portion of the outflow port 1155 located between the end of the outflow port 1155 and the leak port 104. Accordingly, in the outflow port 1155, the portion close to the leak port 104 is thinner than the end part of the outflow port 1155 inscribed in an internal hole portion 220 provided in an engine port. According to this configuration, the portion of the outflow port 1155 close to the leak port 104 can be made to be flexible.

The engine port provided in the intake pipe 22 includes the internal hole portion 220 into which the outflow port 1155 is inserted, and an external hole portion 1221 which is adjacent to an external side of the internal hole portion 220. The leak port 104 is inserted into the external hole portion 1221 and surrounds the fuel supply passage 153 and the leak passage 141 which are next to each other. Therefore, the engine port forms a through hole portion penetrating the tube cross section of the intake pipe 22, in which the recess portion corresponding to the external hole portion 1221 and the internal hole portion 220 penetrating this recess portion are provided in this order from the external to the internal of the intake pipe 22.

Figure 11:
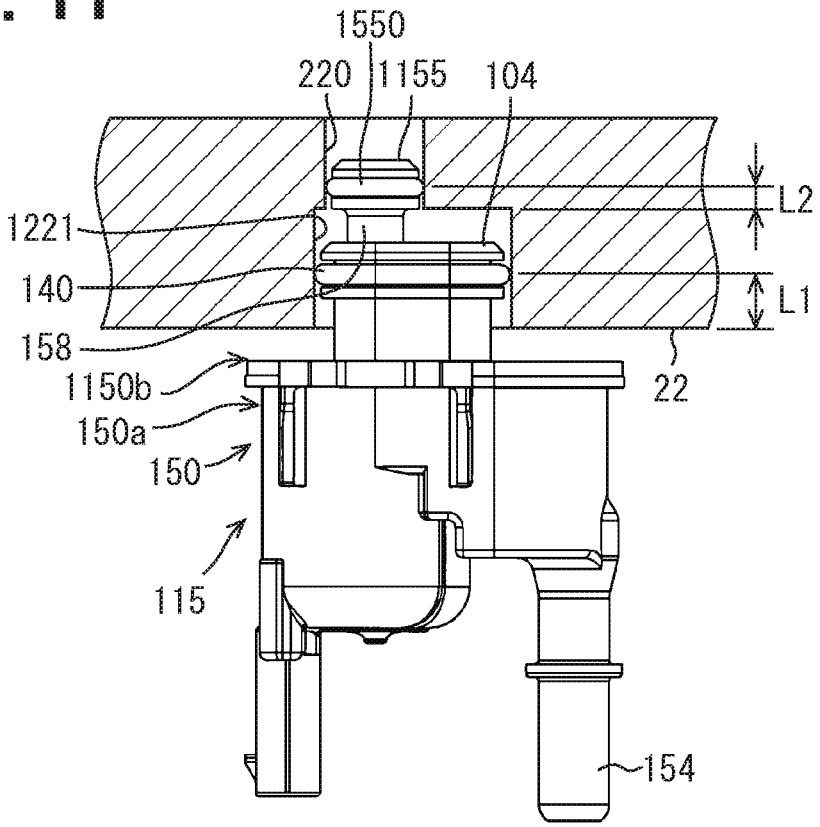
FIG. 11 is a partial sectional view illustrating a connection structure between a purge valve and an intake pipe in a fuel evaporation gas purge system according to at least one embodiment.
Figure 12:
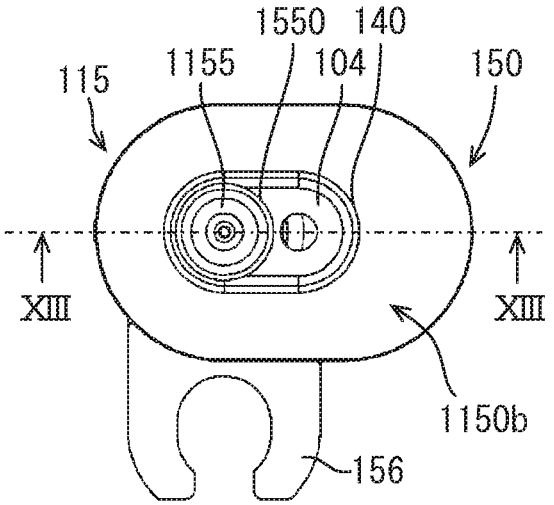
FIG. 12 is a top view illustrating the purge valve.
Figure 13:
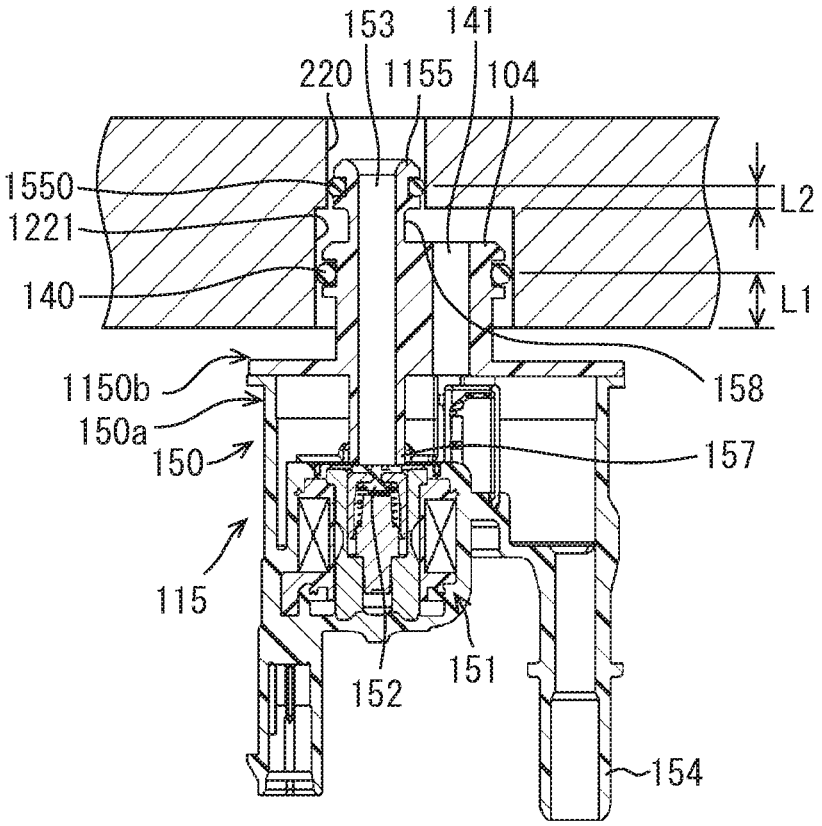
FIG. 13 is a sectional view illustrating the connection structure between the purge valve and the intake pipe.

As shown in FIGS. 11 and 13, when the valve device is properly attached to the intake pipe 22, the outflow port 1155 is inserted into the internal hole portion 220 provided adjacent to the intake passage of the intake pipe 22. A gap between the outer peripheral surface of the outflow port 1155 and the inner peripheral surface of the internal hole portion 220 is sealed by the seal 1550 such as an O-ring attached to the outer circumference of the outflow port 1155. The seal 1550 is an outflow seal which closely adheres to the outflow port 1155 and the engine port to provide a sealed state therebetween.

As shown in FIGS. 11 and 13, when the valve device is properly attached to the intake pipe 22, the leak port 104 is inserted into the external hole portion 1221 so as to be housed inside the external hole portion 1221. A gap between the outer peripheral surface of the leak port 104 and the inner peripheral surface of the external hole portion 1221 is sealed by a seal 140 such as an O-ring attached to the outer circumference of the leak port 104. The seal 140 is a leak seal which closely adheres to the leak port 104 and the engine port to provide a sealed state therebetween. The end portion of the leak passage 141 facing the intake passage is located between the end portion of the internal passage of the outflow port 1155 facing the intake passage and the purge passage 17 or the external of the intake pipe 22. Therefore, in this proper attachment state, the passage leading from the inflow port 154 to the leak passage 141 through the internal passage of the purge valve 115 is dead-end by the seal 1550 and the seal 140 which contact the engine port. As described above, the leak port 104 is provided with a leakage prevention structure for preventing the evaporative fuel and exhaust gas from leaking to the outside when the purge valve 115 is properly attached to the intake pipe 22.

A distance L1 in an axial direction of the external hole portion 1221 between the seal 140 and an open end of the external hole portion 1221 that faces the purge passage 17 or the external of the intake pipe 22 is set to be larger than a distance L2 in an axial direction of the internal hole portion 220 between the seal 1550 and the open end of the internal hole portion 220 that faces the purge passage 17 or the external of the intake pipe 22. According to this configuration, when the purge valve 115 is moved in the axial direction so as to be detached from the intake pipe 22, the seal 1550 is detached from the engine port before the seal 140 is detached from the engine port because L2 is shorter than L1. As a result, even if the seal 1550 has lost sealing performance, the seal 140 is maintained in the sealed state. In this state, the leak passage 141 communicates with the intake passage, but is shut off from the outside of the intake pipe 22 by the sealed state of the seal 140, so that the gas in the purge passage 17 is prevented from flowing out to the atmosphere through the leak passage 141.

Since the internal passage of the outflow port 1155 and the leakage passage 141 are provided next to each other inside an integral structure such as a resin structure, the dimensional accuracy of the outflow port 1155 and the leak port 104 can be easily secured. Further, the internal circumferential shape of the engine port having a high sealing performance can be easily manufactured, and thus, a sealing performance between each of the outflow port 1155 and the leak port 104 and the engine port can be easily secured.

The central axis of the internal passage of the outflow port 1155 and the central axis of the leak passage 141 are arranged apart from each other. The seal 140 is annular and surrounds both the internal passage and the leak passage 141. According to this configuration, the leak port 104 and the outflow port 1155 capable of exerting the desired function can be manufactured by a simple shape, and the productivity of the valve device can be enhanced.

The outflow port 1155 has the constricted portion 158 which is smaller in outer diameter than the seal portion on which the outflow seal is provided and which is formed at a position farther from the intake passage than the seal portion is. According to this configuration, when the outflow port 1155 is inserted into and installed in the internal hole portion 220 of the engine port, the constricted portion 158 is bent. Thus, the required accuracy in dimension with respect to the outflow port 1155 and the leak port 104 can be reduced. Further, according to this configuration, it is possible to improve the workability of installing the outflow port 1155 with respect to the engine port.

The purge valve 115 includes the first member 150*a* in which the drive unit for driving the valve element 152 is housed, and the second member 1150*b* coupled to the first member 150*a* and having the outflow port 1155 and the leak port 104. According to this configuration, it is possible to provide the purge valve 115 which does not need to newly prepare the first member 150*a* only by preparing the second member 1150*b* having the outflow port 1155 and the leak port 104 conforming to the specification of the engine port. Thus, for example, the purge valve 115 is capable of changing the configuration of the outflow port 1155 and the leak port 104. Further, the purge valve 115 is applicable to an evaporative fuel processing system capable of being used for various vehicle product specifications, and can contribute to reducing the number of component management steps in the evaporative fuel processing system.

A valve device of a fuel evaporation gas purge system 1 according to a sixth embodiment will be described with reference to FIGS. 14 to 16. In each drawing of FIGS. 14 to 16, parts having configurations similar to the first embodiment are denoted by the same reference numerals as those in the first embodiment and exert similar operations and effects. In the following description, explanations for configurations, operations and effects of the sixth embodiment that are the same as those of the above-described embodiments will be omitted. That is, features of the sixth embodiment different from those of the above-described embodiments will be described hereafter. Parts in the sixth embodiment having configurations similar to the above-described embodiments exert operations and effects similar to those explained in the above-described embodiments.

Further, a purge valve 215 of the sixth embodiment includes a leak port 204 leading to the inflow port 154 through the internal passage provided inside the body 150 and also leading to an outside of the body 150. The leak port 204 has therein an internal leak passage 241 connected to the internal passage of the body 150, and protrudes from the body 150 independently of the outflow port 2155. The central axis of the fuel supply passage 153 of the outflow port 2155 and the central axis of the leak passage 241 are arranged apart from each other. Therefore, the leak port 204 and the outflow port 2155 constitute pipes which protrude from separate positions on the main body 150.

The purge valve 215 includes the body 150. The body 150 includes at least a first member 150*a* including therein the fuel supply passage 153 and an electromagnetic coil 151, and a second member 2150*b* coupled to the first member 150*a*. Each of the first member 150*a* and the second member 2150*b* is formed of a resin material.

The second member 2150*b* has a flange overlapped and integrally joined with the flange of the first member 150*a*. The second member 2150*b* includes a cylindrical portion which protrudes from a surface of the track-shaped flange of the second member 150*b* in its thickness direction. In a state in which the first member 150*a* and the second member 2150*b* are coupled to each other, the first member 150*a* and the second member 2150*b* support a filter interposed therebetween.

The cylindrical portion of the second member 2150*b* forms the fuel supply passage 153. In a state where the first member 150*a* and the second member 2150*b* are coupled to each other, the cylindrical portion protrudes into the first member 150*a*. The cylindrical portion has therein the fuel supply passage 153 into which evaporative fuel flows from the inflow port 154 when the valve element 152 is in a valve open state.

The second member 2150*b* includes an outflow port 2155 leading to the inflow port 154 through the internal passage of the first member 150*a* and communicating with the intake passage. Further, the second member 2150*b* includes the leak port 204 leading to the inflow port 154 through the internal passage provided inside the first member 150*a* and also leading to an outside of the body 150. The leak passage 241 of the leak port 204 is also connected to the fuel supply passage 153 when the valve element 152 is separated from the valve seat 157. The leak port 204 has a cylindrical shape in which the internal leak passage 241 is connected to the internal passage of the body 150, and protrudes similar to the outflow port 2155 of the second member 2150*b*.

The end of the outflow port 2155 protrudes toward the intake passage more than the leak port 204. The outflow port 2155 has a constricted portion 158 projecting closer to the intake passage than the leak port 204 and positioned closer to the valve element 152 than a sealed portion externally fitted with a seal 1550A. The constricted portion 158 has a smaller outer diameter than the sealed portion externally fitted with the seal 1550A. The constricted portion 158 corresponds to a portion of the outflow port 2155 located between the end of the outflow port 2155 and a sealed portion externally fitted with a seal 1550B. Accordingly, in the outflow port 2155, the portion close to the sealed portion externally fitted with the seal 1550B is thinner than the end part of the outflow port 2155 inscribed in an internal hole portion 220 provided in an engine port. According to this configuration, the outflow port 2155 can be made to be flexible.

The leak port 204 includes a constricted portion 159 positioned closer to the first member 150*a* than a sealed portion externally fitted with a seal 240 is. The constricted portion 159 has a smaller outer diameter than the sealed portion externally fitted with the seal 240. The constricted portion 159 corresponds to a portion of the leak port 204 between an end of the leak port 204 and a flange portion of the second member 2150*b*.

The engine port provided in the intake pipe 22 includes the internal hole portion 220 into which an internal side of the outflow port 2155 is inserted, an external hole portion 2221 into which an external side of the outflow port 2155 is inserted, and a leak-port recess portion 2222 into which the leak port 204 is inserted. The internal hole portion 220 and the external hole portion 2221 have inner diameters substantially equal to each other, and are coaxial with each other. The intake pipe 22 includes a through hole portion connecting an internal and external of the intake pipe 22 via the internal hole portion 220 and the external hole portion 2221. The leak-port recess portion 2222 is positioned next to the external hole portion 2221. The engine port includes a communication passage 2223 through which the leak-port recess portion 2222 communicates with the internal hole portion 220 on a bottom side of the leak-port recess portion 2222.

Figure 14:
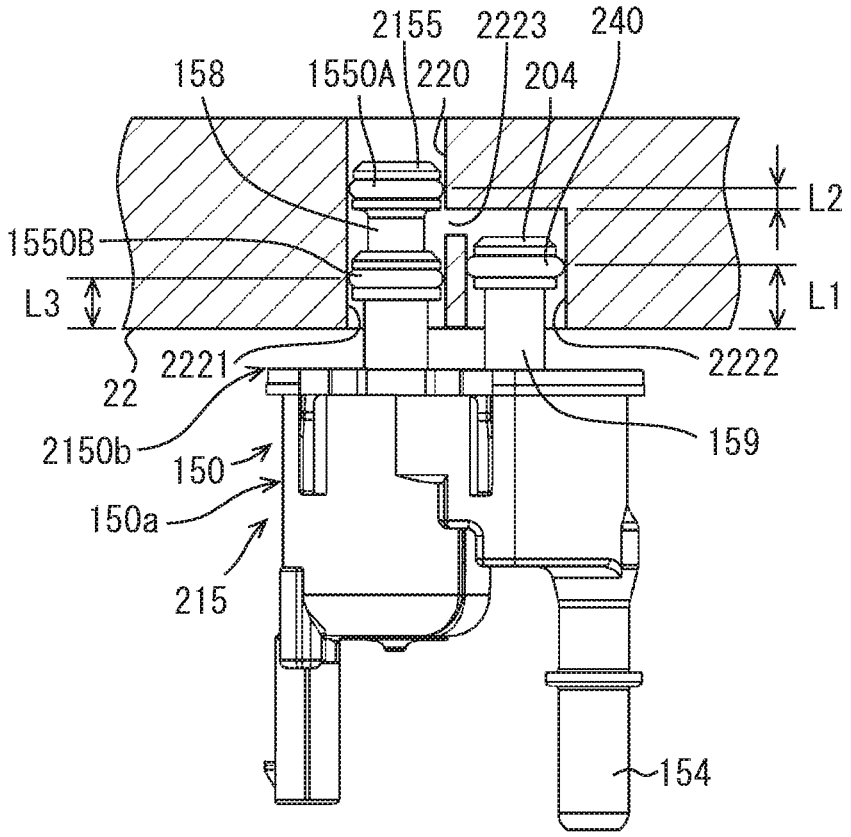
FIG. 14 is a partial sectional view illustrating a connection structure between a purge valve and an intake pipe in a fuel evaporation gas purge system according to at least one embodiment.
Figure 15:
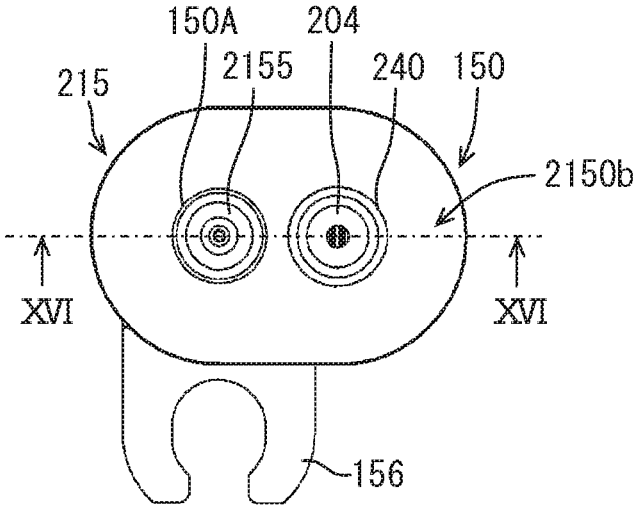
FIG. 15 is a top view illustrating the purge valve.
Figure 16:
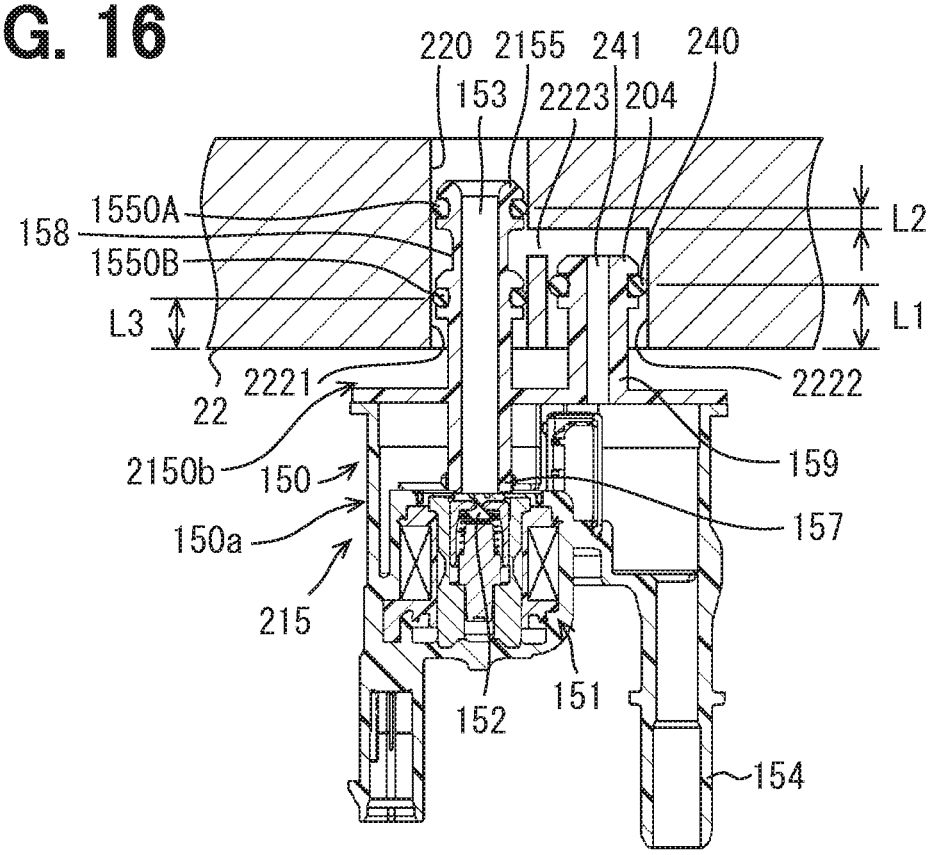
FIG. 16 is a sectional view illustrating the connection structure between the purge valve and the intake pipe.

As shown in FIGS. 14 and 16, when the valve device is properly attached to the intake pipe 22, a portion of the outflow port 2155 adjacent to the intake passage, i.e., an end portion of the outflow port 2115 is inserted into the internal hole portion 220 of the intake pipe 22. A gap between the outer peripheral surface of the outflow port 2155 and the inner peripheral surface of the internal hole portion 220 is sealed by the seal 1550A such as an O-ring attached to the outer circumference of the outflow port 2155. A portion of the outflow port 2155 leading to the purge passage 17, i.e., a portion of the outflow port 2115 facing the main body 150, is connected to and inserted into the inside of the external hole portion 2221 of the intake pipe 22. The seal 1550A is an outflow seal which closely adheres to the outflow port 1155 and the engine port to provide a sealed state therebetween. A gap between the outer peripheral surface of the outflow port 2155 and the inner peripheral surface of the external hole portion 2221 is sealed by the seal 1550B such as an O-ring attached to the outer circumference of the outflow port 2155. The seal 1550B is an external seal that ensures sealing performance between the outflow port 2155 and the engine port on an external side of the seal 1550A.

As shown in FIGS. 14 and 16, when the valve device is properly attached to the intake pipe 22, the leak port 204 is inserted into the leak-port recess portion 2222 so as to be housed inside the leak-port recess portion 2222. A gap between the outer peripheral surface of the leak port 204 and the inner peripheral surface of the leak-port recess portion 2222 is sealed by a seal 240 such as an O-ring attached to the outer circumference of the leak port 204. The seal 240 is a leak seal which closely adheres to the leak port 204 and the engine port to provide a sealed state therebetween. The end portion of the leak passage 241 facing the intake passage is located between the end portion of the internal passage of the outflow port 2155 facing the intake passage and the purge passage 17 or the external of the intake pipe 22. Therefore, in this proper attachment state, the passage leading from the inflow port 154 to the leak passage 241 through the internal passage of the purge valve 215 is dead-end by the seal 1550A, the seal 1550B and the seal 240 which are in contact with the engine port. As described above, the leak port 204 is provided with a leakage prevention structure for preventing the evaporative fuel and exhaust gas from leaking to the outside when the purge valve 215 is properly attached to the intake pipe 22.

The distance L1 in the axial direction between the seal 240 and the open end of the leak-port recess portion 2222 facing the external is larger than the distance L2 in the axial direction between the seal 1550A and the open end of the internal hole portion 220 facing the external. The distance L3 in an axial direction of the external hole portion 2221 between the external side open end of the external hole portion 2221 and the seal 15506 is set to be larger than the axial distance L1. According to this configuration, when the purge valve 215 is moved in the axial direction so as to be detached from the intake pipe 22, the seal 1550A is detached from the engine port before the seal 240 is detached from the engine port because L2 is shorter than L1. Similarly, since L2 is shorter than L3, the seal 1550A is detached from the engine port prior to the seal 1550B. As a result, even if the seal 1550A has lost sealing performance, the seal 240 and the seal 1550B are maintained in the sealed state. In this state, the leak passage 241 communicates with the intake passage, but is shut off from the outside of the intake pipe 22 by the sealed state of the seal 240 and the sealed state of the seal 1550B, so that the gas in the purge passage 17 is prevented from flowing out to the atmosphere through the leak passage 241.

According to the sixth embodiment, since the inner diameter dimensions of the leak-port recess portion 2222, the internal hole portion 220 and the external hole portion 2221 can be set to approximately equal to each other, a common product having the same size can be used for the three seals. Accordingly, in the valve device, the number of control steps for the seals can be reduced and the kinds of the seals can be reduced.

The central axis of the internal passage of the outflow port 2155 and the central axis of the leak passage 241 are arranged apart from each other. The engine port has the external hole portion 2221 provided on an external side of the seal 1550A. The outflow port 2155 and the external hole portion 2221 are sealed therebetween by the seal 1550B provided on an external side of the seal 1550A. The distance L3 in the axial direction between the seal 1550B and the open end of the external hole portion 2221 facing the external is larger than the distance L2 in the axial direction between the seal 1550A and the open end of the internal hole portion 220 facing the external. According to the configuration, when the outflow port 2155 and the leak port 204 move in a direction away from the engine port, the sealed state of the seal 1550A can be broken before breakage of the sealed state of the seal 1550B. Thus, even when the sealing performance of the seal 1550A is lost, the sealing performance of the seal 1550B can be maintained. Thus, in the valve device, the evaporative fuel flowing out from the leak passage 241 can be made to flow into the intake passage without leaking to the outside from the engine port.

The outflow port 2155 has the constricted portion 158 which is smaller in outer diameter than the seal portion on which the outflow seal is provided and which is formed at a position farther from the intake passage than the seal portion is. According to this configuration, when the outflow port 2155 is inserted into and installed in the internal hole portion 220 of the engine port, since the constricted portion 158 is flexible, the required accuracy in dimension with respect to the coaxial relation between the outflow port 2155 and the leak port 204 can be reduced. Further, according to this configuration, it is possible to improve the workability of installing the outflow port 2155 with respect to the engine port.

The purge valve 215 includes the first member 150*a* in which the drive unit for driving the valve element 152 is housed, and the second member 2150*b* coupled to the first member 150*a* and having the outflow port 2155 and the leak port 204. According to this configuration, it is possible to provide the purge valve 215 which does not need to newly prepare the first member 150*a* only by preparing the second member 2150*b* having the outflow port 2155 and the leak port 204 conforming to the specification of the engine port. Thus, for example, the purge valve 215 is capable of changing the configuration of the outflow port 2155 and the leak port 204. Further, the purge valve 215 is applicable to an evaporative fuel processing system capable of being used for various vehicle product specifications, and can contribute to reducing the number of component management steps in the evaporative fuel processing system.

A valve device of a fuel evaporation gas purge system 1 according to a seventh embodiment will be described with reference to FIGS. 17 to 19. In each drawing of FIGS. 17 to 19, parts having configurations similar to the first embodiment are denoted by the same reference numerals as those in the first embodiment and exert similar operations and effects. In the following description, explanations for configurations, operations and effects of the seventh embodiment that are the same as those of the above-described embodiments will be omitted. That is, features of the seventh embodiment different from those of the above-described embodiments will be described hereafter. Parts in the seventh embodiment having configurations similar to the above-described embodiments exert operations and effects similar to those explained in the above-described embodiments.

Further, a purge valve 315 of the seventh embodiment includes a leak port 304 leading to the inflow port 154 through the internal passage provided inside the body 150 and also leading to an outside of the body 150. The leak port 304 has therein an internal leak passage 241 connected to the internal passage of the body 150, and protrudes from the second member 3150*b* of the body 150 independently of the outflow port 3155. Therefore, the leak port 304 and the outflow port 3155 constitute pipes which protrude from separate positions on the main body 150.

The purge valve 315 includes the body 150. The body 150 includes at least a first member 150*a* including therein the fuel supply passage 153 and an electromagnetic coil 151, and a second member 3150*b* coupled to the first member 150*a*. Each of the first member 150*a* and the second member 3150*b* is formed of a resin material.

The second member 3150*b* has a flange overlapped and integrally joined with the flange of the first member 150*a*. The second member 3150*b* includes a cylindrical portion which protrudes from a surface of the track-shaped flange of the second member 150*b* in its thickness direction. In a state in which the first member 150*a* and the second member 3150*b* are coupled to each other, the first member 150*a* and the second member 3150*b* support a filter interposed therebetween.

The cylindrical portion of the second member 3150*b* forms the fuel supply passage 153. In a state where the first member 150*a* and the second member 3150*b* are coupled to each other, the cylindrical portion protrudes into the first member 150*a*. The cylindrical portion has therein the fuel supply passage 153 into which evaporative fuel flows from the inflow port 154 when the valve element 152 is in a valve open state.

The second member 3150*b* includes an outflow port 3155 leading to the inflow port 154 through the internal passage of the first member 150*a* and communicating with the intake passage. Further, the second member 3150*b* includes the leak port 304 leading to the inflow port 154 through the internal passage provided inside the first member 150*a* and also leading to an outside of the body 150. The leak port 304 has a cylindrical shape in which the internal leak passage 241 is connected to the internal passage of the body 150, and protrudes similar to the outflow port 3155 of the second member 3150*b*.

The end of the outflow port 3155 protrudes toward the intake passage more than the leak port 304. The outflow port 3155 has a constricted portion 158 projecting closer to the intake passage than the leak port 304 and positioned closer to the first member 150*a* than a sealed portion externally fitted with a seal 1550. Accordingly, in the outflow port 3155, the portion close to the first member 150*a* is thinner than the end part of the outflow port 3155 inscribed in an through hole portion 3221 provided in an engine port. According to this configuration, the outflow port 3155 can be made to be flexible.

The leak port 304 includes a constricted portion 159 positioned closer to the first member 150*a* than a sealed portion externally fitted with a seal 240 is. The constricted portion 159 corresponds to a portion of the leak port 304 between an end of the leak port 304 and a flange portion of the second member 2150*b*.

The intake pipe 22 includes a through hole portion 3221 into which the outflow port 3155 is inserted, and a leak-port recess portion 3222 into which a leak port 304 is inserted. The leak-port recess portion 3222 is positioned next to the through hole portion 3221. The intake pipe 22 includes a communication passage 3223 penetrating to the intake passage at a part of the bottom surface of the leak-port recess portion 3222. The through hole portion 3221 is a main engine port, and the leak-port recess portion 3222 and the communication passage 3223 are a sub engine port. The main engine port and the sub engine port are independent passages.

Figure 17:
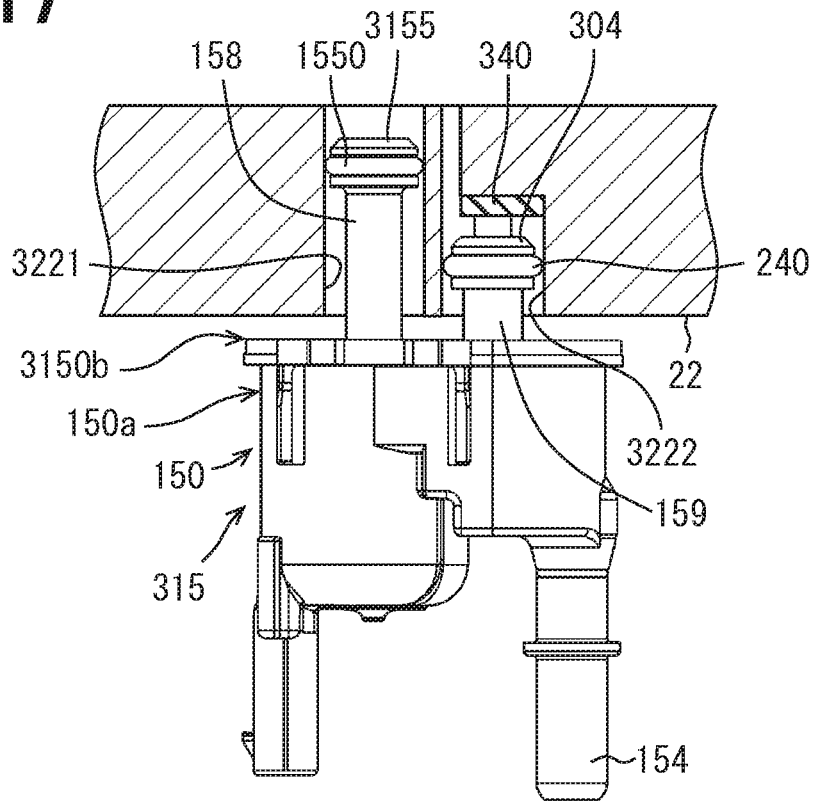
FIG. 17 is a partial sectional view illustrating a connection structure between a purge valve and an intake pipe in a fuel evaporation gas purge system according to at least one embodiment.
Figure 18:
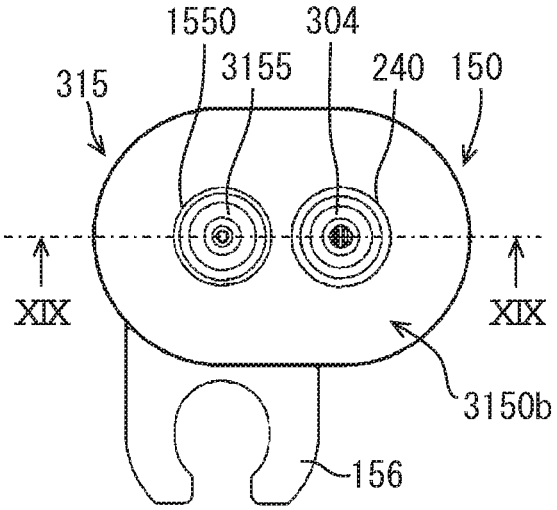
FIG. 18 is a top view illustrating the purge valve.
Figure 19:
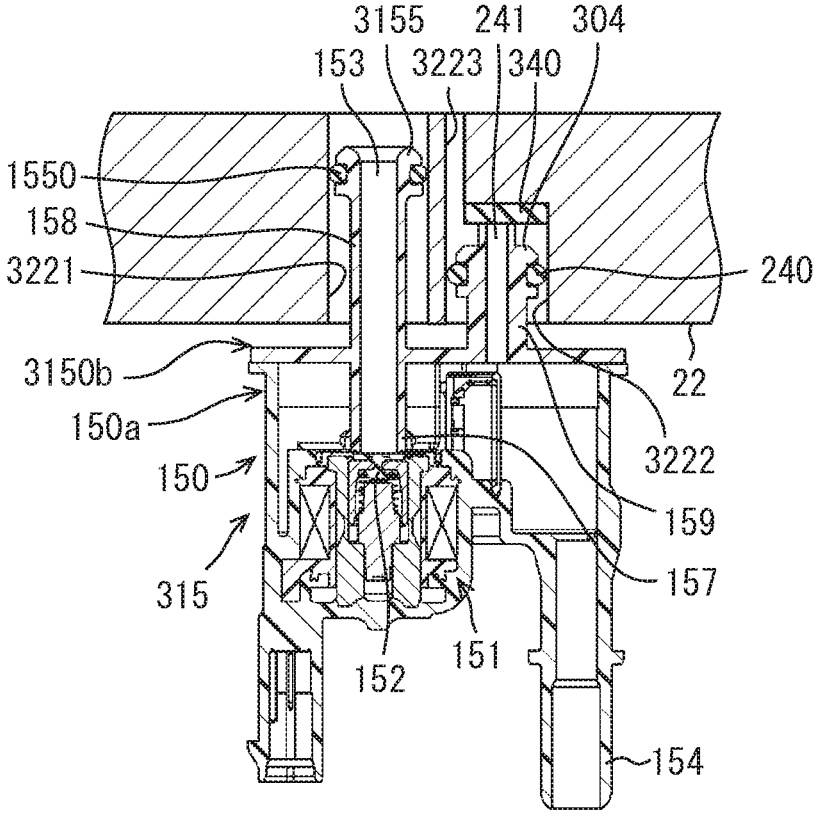
FIG. 19 is a sectional view illustrating the connection structure between the purge valve and the intake pipe.

As shown in FIGS. 17 and 19, when the valve device is properly attached to the intake pipe 22, a portion of the outflow port 3155 adjacent to the intake passage, i.e., an end portion of the outflow port 3115 is inserted into the through hole portion 3221 of the intake pipe 22. A gap between the outer peripheral surface of the outflow port 3155 and the inner peripheral surface of the through hole portion 3221 is sealed by the seal 1550 such as an O-ring attached to the outer circumference of the outflow port 3155.

As shown in FIGS. 17 and 19, when the valve device is properly attached to the intake pipe 22, the leak port 304 is inserted into the leak-port recess portion 3222 so as to be housed inside the leak-port recess portion 3222. A gap between the outer peripheral surface of the leak port 304 and the inner peripheral surface of the leak-port recess portion 3222 is sealed by a seal 240 such as an O-ring attached to the outer circumference of the leak port 304.

A seal 340 elastically deformable by being pressed by an end of the leak port 304 is housed on the bottom surface of the leak-port recess portion 3222. The seal 240 is a second leak seal which is provided on an external side of the seal 340 and closely adheres to the leak port 304 and the sub engine port to provide a sealed state therebetween. As shown in FIGS. 17 and 19, when the valve device is properly attached to the intake pipe 22, the bottom surface of the leak-port recess portion 3222 and the end portion of the leak port 304 are in close contact with each other via the seal 340. The seal 340 is a first leak seal which closely adheres to the leak port 304 and the sub engine port to provide a sealed state therebetween. Therefore, the seal 340 seals between the leak passage 241 and the leak-port recess portion 3222 and between the leak passage 241 and the communication passage 3223. Accordingly, the passage leading from the inflow port 154 to the leak passage 241 is dead-ended by the seal 340. As described above, the leak port 304 is provided with a leakage prevention structure for preventing the evaporative fuel and exhaust gas from leaking to the outside when the purge valve 315 is properly attached to the intake pipe 22.

The first leak seal constituting the leak prevention structure at the leak port 304 is provided on an external side of the seal 1550. According to this configuration, when the purge valve 315 is detached from the intake pipe 22, the seal 340 can be made incapable of exerting its function before the seal 1550 and the seal 240. Therefore, when the valve device is dropped, the leak port 304 can be surely dropped, and early leak detection can be realized.

According to the seventh embodiment, since the sealed state of the seal 340 is the first to become broken at the time of detachment of the valve device, a dimensional design in consideration of the positional relationship between the seals can be eliminated. Moreover, since the seal 340 is elastically deformed by being pushed in the axial direction by the end of the leak port 304, the sealing function is lost by slight axial movement when the valve device is dropped off. Therefore, in the valve device, a leak detection can be performed even if the valve device is slightly detached.

The purge valve 15 includes the outflow port 3155 inserted into the main engine port, and the cylindrical leak port 304 having the leak passage 241. The leak port 304 is inserted into the sub engine port formed in the passage forming member so as to communicate with the intake passage independently of the main engine port. The purge valve 15 includes the outflow seal providing a sealed state between the outflow port 3155 and the main engine port, the first leak seal and second leak seal providing a sealed state between the leak port 304 and the sub engine port. The second leak seal provides a sealed state between the leak port 304 and the sub engine port. When the outflow port 3155 and the leak port 304 move in a direction away from the main engine port and the sub engine port, the first leak seal is provided such that the sealed state of the first leak seal becomes broken before breakage of the sealed state of the outflow seal and the leak seal.

According to this configuration, even if the outflow port 3155 and the leak port 304 move in the direction away from each of the engine ports at the time of breakage of the proper attachment state of the valve device in the blocking state of the purge valve 15, the sealed state of the first leak seal becomes broken before breakage of the sealed state of the outflow seal and the second leak seal. Thus, even when the sealing performance of the first leak seal is lost, the outflow seal and the second leak seal maintain their sealing performance. Therefore, the evaporative fuel or the like flowing out of the leak passage 241 is capable of flowing out to the intake passage without leaking from the sub engine port to the outside of the passage forming member. According to this configuration, in the valve device, external leakage of gas can be reduced when the proper attachment state of the valve device is broken.

The central axis of the internal passage of the outflow port 3155 and the central axis of the leak passage 241 are arranged apart from each other. The sealed state between the leak-port recess portion 3222 of the sub engine port and the end of the leak port 304 is provided by the first leak seal. The second leak seal is an external seal provided on the external side of the first leak seal.

According to this configuration, the first leak seal can be disposed on the external side of the external seal in the leak-port recess portion 3222. Accordingly, when the outflow port 3155 and the leak port 304 move in a direction away from the respective engine ports, the sealed state of the first leak seal can be broken immediately. Further, even when the end portion of the leak port 304 is separated from the first leak seal, the sealed state between the leak port 304 and the leak-port recess portion 3222 can be maintained by the external seal. Therefore, the valve device capable of exerting the desired function can be manufactured by a simple shape, and the productivity of the valve device can be enhanced.

The outflow port 3155 has the constricted portion 158 which is smaller in outer diameter than the seal portion on which the outflow seal is provided and which is formed at a position farther from the intake passage than the seal portion is. According to this configuration, when the outflow port 3155 is inserted into and installed in the through hole portion 3221 of the engine port, since the constricted portion 158 is flexible, the required accuracy in dimension with respect to the coaxial relation between the outflow port 3155 and the leak port 304 can be reduced. Further, according to this configuration, it is possible to improve the workability of installing the outflow port 3155 with respect to the engine port.

The purge valve 315 includes the first member 150*a* in which the drive unit for driving the valve element 152 is housed, and the second member 3150*b* coupled to the first member 150*a* and having the outflow port 3155 and the leak port 304. According to this configuration, it is possible to provide the purge valve 315 which does not need to newly prepare the first member 150*a* only by preparing the second member 3150*b* having the outflow port 3155 and the leak port 304 conforming to the specification of the engine port. Thus, for example, the purge valve 315 is capable of changing the configuration of the outflow port 3155 and the leak port 304. Further, the purge valve 315 is applicable to an evaporative fuel processing system capable of being used for various vehicle product specifications, and can contribute to reducing the number of component management steps in the evaporative fuel processing system.

The disclosure of this specification is not limited to the illustrated embodiment. The disclosure encompasses the illustrated embodiments and modifications by those skilled in the art based thereon. The present disclosure is not limited to combinations disclosed in the above-described embodiments but can be implemented in various modifications. The present disclosure can be implemented in various combinations. The disclosure may have additional parts that may be added to the embodiments. The disclosure encompasses the omission of components and elements of the embodiments. The disclosure encompasses the replacement or combination of components, elements between one embodiment and another. The disclosed technical scope is not limited to the description of the embodiments.

In the above-described embodiments, the outflow port and the leak port are connected to the intake pipe 22, but what is only required is that the fuel supply passage 153 is connected to the intake passage of the engine, and the present invention is not limited to the above-described embodiment. That is, the valve device is not limited to being directly attached to the intake pipe 22, but may be configured to be attached to a passage forming member that is a member that forms the intake passage. For example, the outflow port and the leak port may be connected to an intake manifold 20 forming the intake passage. Further, the outflow port and the leak port may be connected to the intake pipe 22 through an attachment member which forms the intake passage.

In the above-described embodiment, the pressure sensor 11 is an example of a device for detecting a pressure at a predetermined place included in a passage leading from the inside of the fuel tank 10 to the purge valve 15 which is a valve device. Accordingly, the pressure at the predetermined place may be detected by a sensor provided in the purge passage 17 or the vapor passage 16.

In the above-described embodiments, the purge valve is used as the valve device attached to the intake pipe 22, but the valve device may be a device having a valve capable of switching between a fully open state in which the passage leading to the intake passage of the engine 2 is open and a fully closed state in which the valve device is closed. For example, the valve device may be a switching valve that can be switched between the fully open state and the fully closed state, and a purge valve that can adjust the opening degree of the passage may be provided closer to the canister 13 than the valve device. Further, the valve device provided to communicate with the intake passage may be configured to include the purge pump 14 and a purge valve.

When the system 1 is configured to seal the inside of the fuel tank, the abnormality determination similar to that in the above-described embodiments can be performed by using the pressure measured in the purge passage to the valve device except the fuel tank.

In the embodiments described above, the system 1 may be configured without the turbocharger or the throttle valve.

While the present disclosure has been described with reference to examples, it is understood that the present disclosure is not limited to the disclosed examples and structures described above. Rather, the present disclosure encompasses various modifications and variations within the scope of equivalents. In addition, while the various elements are shown in various combinations and configurations, which are exemplary, other combinations and configurations, including more, less or only a single element, are also within the spirit and scope of the present disclosure.

The invention claimed is:

1. A valve device attached to a passage forming member defining an intake passage of an engine that mixes and combusts combustion fuel and evaporative fuel flowing out of an inside of a fuel tank, the valve device including a valve element that switches between a permitting state permitting inflow of the evaporative fuel into the intake passage and a blocking state blocking the inflow of the evaporative fuel into the intake passage, the valve device controlling a flow of the evaporative fuel, the valve device comprising:

an inflow port having an inflow passage into which the evaporative fuel flows;

an outflow port having a cylindrical shape and inserted into an engine port provided on the passage forming member so as to communicate with the intake passage, the outflow port including an internal passage into which the evaporative fuel flows from the inflow port in the permitting state or does not flow from the inflow port in the blocking state;

a leak port having a cylindrical shape and inserted into the engine port, the leak port including a leak passage into which the evaporative fuel is allowed to flow from the inflow port regardless of the permitting state and the blocking state;

an outflow seal providing a sealed state between the outflow port and the engine port;

a leak seal providing a sealed state between the leak port and the engine port;

a first member in which a drive unit for driving the valve element is housed, and a second member coupled to the first member and having the outflow port and the leak port, wherein the outflow seal is positioned such that the sealed state of the outflow seal becomes broken before breakage of the sealed state of the leak seal when the outflow port and the leak port move in a direction away from the engine port, the first member has a cup shape defining an opening and having a first flange, the second member has a second flange, and the first member is integrally coupled to the second member by overlapping and welding the first flange and the second flange to each other.

2. The valve device according to claim 1, wherein the engine port includes a first hole portion which is defined by the passage forming member and into which the outflow port is inserted such that the sealed state of the outflow seal is provided between the first hole portion and the outflow port, and a second hole portion which is defined by the passage forming member and into which the leak port is inserted such that the sealed state of the leak seal is provided between the second hole portion and the leak port, and a distance in an axial direction of the second hole portion between the leak seal and an open end of the second hole portion facing an external of the passage forming member is larger than a distance in an axial direction of the first hole portion between the outflow seal and an open end of the first hole portion facing the external.

3. The valve device according to claim 1, wherein the outflow port and the leak port are coaxial with each other, and the leak passage is a cylindrical passage surrounding the internal passage of the outflow port.

4. The valve device according to claim 1, wherein a central axis of the internal passage of the outflow port and a central axis of the leak passage are arranged apart from each other, and the leak seal has an annular shape to surround both the internal passage and the leak passage.

5. The valve device according to claim 1, wherein a central axis of the internal passage of the outflow port and a central axis of the leak passage are arranged apart from each other, the engine port includes a first hole portion which is defined by the passage forming member and into which the outflow port is inserted such that the sealed state of the outlet seal is provided between the first hole portion and the outflow port, and an external hole portion provided between the outflow seal and an external of the passage forming member, the outflow port and the external hole portion are sealed therebetween by an external seal provided between the outflow seal and the external of the passage forming member, and a distance in an axial direction of the external hole portion between the external seal and an open end of the external hole portion facing the external is larger than a distance in an axial direction of the first hole portion between the outflow seal and an open end of the first hole portion facing the external.

6. The valve device according to claim 1, wherein the outflow port includes a constricted portion which is smaller in outer diameter than a seal portion of the outflow port on which the outflow seal is provided, the constricted portion being farther from the intake passage than the seal portion is from the intake passage.

7. A fuel evaporation gas purge system comprising:

a fuel tank storing fuel;

a canister adsorbing evaporative fuel when taking in evaporative fuel gas generated in the fuel tank, and capable of desorbing the adsorbed evaporative fuel;

a passage forming member forming an intake passage of an engine that mixes and combusts at least the combustion fuel and the evaporative fuel desorbed from the canister; and the valve device according to claim 1.

8. A valve device attached to a passage forming member defining an intake passage of an engine that mixes and combusts combustion fuel and evaporative fuel flowing out of an inside of a fuel tank, the valve device including a valve element that switches between a permitting state permitting inflow of the evaporative fuel into the intake passage and a blocking state blocking the inflow of the evaporative fuel into the intake passage, the valve device controlling a flow of the evaporative fuel, the valve device comprising:

an inflow port having an inflow passage into which the evaporative fuel flows;

an outflow port having a cylindrical shape and inserted into a main engine port provided on the passage forming member so as to communicate with the intake passage, the outflow port including an internal passage into which the evaporative fuel flows from the inflow port in the permitting state or does not flow from the inflow port in the blocking state;

a leak port having a cylindrical shape and including a leak passage into which the evaporative fuel is allowed to flow from the inflow port regardless of the permitting state and the blocking state, the leak port being inserted into a sub engine port provided on the passage forming member so as to communicate with the intake passage independently of the main engine port;

an outflow seal providing a sealed state between the outflow port and the main engine port;

a first leak seal providing a sealed state between the leak port and the sub engine port; and a second leak seal providing a sealed state between the leak port and the sub engine port, wherein the first leak seal is positioned such that the sealed state of the first leak seal becomes broken before breakage of the sealed state of the outflow seal and the second leak seal when the outflow port and the leak port move in a direction away from the main engine port and the sub engine port.

9. The valve device according to claim 8, wherein a central axis of the internal passage of the outflow port and a central axis of the leak passage are arranged apart from each other, the sub engine port includes a leak-port recess portion in which the first leak seal provides the sealed state between the leak-port recess portion and an end of the leak port, and the second leak seal is an external seal provided between the first leak seal and an external of the passage forming member.

10. A valve device for controlling a flow of evaporative fuel into an intake pipe of an engine, the valve device comprising:

a body housing a valve element movable between a permitting position and a blocking position;

an inflow port through which the evaporative fuel flows into the body;

an outflow port protruding from the body and inserted from an external of the intake pipe into an inner hole provided in the intake pipe such that the outflow port communicates with an internal of the intake pipe through the inner hole, the outflow port communicating with the inflow port when the valve element is at the permitting position and being shut off from the inflow port when the valve element is at the blocking position;

a leak port protruding from the body and inserted from the external of the intake pipe into a recess provided on an outer surface of the intake pipe, the recess having a bottom surface recessed from the outer surface of the intake pipe, the inner hole extending from the bottom surface of the recess to the internal of the intake pipe, the leak port communicating with the inflow port;

an outflow seal fitted on an outer circumference of the outflow port so as to seal a gap between the outflow port and the inner hole; and a leak seal fitted on an outer circumference of the leak port so as to seal a gap between the leak port and the recess;

a first member in which a drive unit for driving the valve element is housed; and a second member coupled to the first member and having the outflow port and the leak port, wherein a distance between the outflow seal and the bottom surface of the recess is smaller than a distance between the leak seal and the outer surface of the intake pipe, the first member has a cup shaped defining an opening and a first flange, the second member has a second flange, and the first member is integrally coupled to the second member by overlapping and welding the first flange and the second flange to each other.

* * * * *